US009828708B2

(12) United States Patent
Pryne

(10) Patent No.: US 9,828,708 B2
(45) Date of Patent: Nov. 28, 2017

(54) METHOD AND APPARATUS FOR PRODUCING NONWOVEN MATERIALS

(71) Applicant: AFFCO, New Windsor, NY (US)

(72) Inventor: Wilson H. Pryne, Jefferson, NY (US)

( * ) Notice: Subject to any disclaimer, the term of this patent is extended or adjusted under 35 U.S.C. 154(b) by 394 days.

(21) Appl. No.: 14/625,941

(22) Filed: Feb. 19, 2015

(65) Prior Publication Data

US 2016/0194795 A1 Jul. 7, 2016

Related U.S. Application Data

(60) Provisional application No. 61/972,642, filed on Mar. 31, 2014.

(51) Int. Cl.

| | |
|---|---|
| ***D04H 1/46*** | (2012.01) |
| ***D04H 3/105*** | (2012.01) |
| ***D04H 18/02*** | (2012.01) |
| ***D04H 3/10*** | (2012.01) |

(52) U.S. Cl.

CPC ..... *D04H 1/46* (2013.01); *D04H 3/10* (2013.01); *D04H 3/105* (2013.01); *D04H 18/02* (2013.01)

(58) Field of Classification Search

CPC ..... D04H 18/02; D04H 18/00; D04H 1/46; D04H 3/102; D04H 3/105; D04H 5/02; D04H 13/005; D04H 1/48; D04H 11/08; D04H 3/10

USPC ..... 28/107, 115, 108, 111

See application file for complete search history.

(56) References Cited

U.S. PATENT DOCUMENTS

| | | | | |
|---|---|---|---|---|
| 1,748,296 A * | 2/1930 | Lombard | D06F 17/04 366/282 |
| 3,090,100 A | 5/1963 | Smith, II | |
| 3,257,259 A * | 6/1966 | Law | D04H 1/46 28/107 |
| 3,451,885 A * | 6/1969 | Klein | B32B 5/022 156/148 |

(Continued)

OTHER PUBLICATIONS

International Search Retort issued in application No. PCT/US15/22641 dated Jun. 25, 2015.

(Continued)

*Primary Examiner* — Amy Vanatta

(74) *Attorney, Agent, or Firm* — Nixon & Vanderhye, PC

(57) ABSTRACT

A method of producing a needled product of a selected material or materials of a desired thickness and size. A first carded batt of a selected material or materials is moved from a feed support into a needle loom between a vertically reciprocating needle bed and a support bed located beneath and in spaced relation to the needle bed. The needle bed and/or the support bed are vertically movable to vary the spacing therebetween. The upper surface of the first carded batt is penetrated by the needles in the needle loom so that the needles do not reach an upper surface of the support bed and are able to flex laterally. The needled first batt is then lifted and moved to the feed support or a feed support for another needle loom. Thereafter, a second batt is positioned over the first batt in overlapping relation, the needle bed or support bed is moved to increase the vertical spacing therebetween to accommodate the overlapped batts, and the batts are moved through the needle loom and connected. This method may be repeated to add additional overlapped batts to produce a layered product of any suitable thickness.

18 Claims, 27 Drawing Sheets

(56) References Cited

U.S. PATENT DOCUMENTS

| | | | | | |
|---|---|---|---|---|---|
| 3,845,529 | A * | 11/1974 | Van Deusen | D04H 18/02 | 156/148 |
| 3,935,046 | A * | 1/1976 | Kiernan | D04H 1/48 | 156/148 |
| 4,790,052 | A * | 12/1988 | Olry | B29C 33/56 | 156/148 |
| 5,196,037 | A | 3/1993 | Rossi et al. | | |
| 5,515,585 | A | 5/1996 | Sheehan et al. | | |
| 5,671,518 | A * | 9/1997 | Kummermehr | C03C 25/42 | 28/107 |
| 6,009,605 | A * | 1/2000 | Olry | B29B 11/16 | 28/107 |
| 6,105,223 | A | 8/2000 | Brown et al. | | |
| 6,405,417 | B1 * | 6/2002 | Sheehan | G03G 15/657 | 28/107 |
| 6,767,602 | B1 * | 7/2004 | Duval | C04B 35/83 | 156/148 |
| 7,430,790 | B1 | 10/2008 | Bowles et al. | | |
| 2001/0005927 | A1 * | 7/2001 | Ruiz | D04H 1/498 | 28/107 |
| 2005/0268443 | A1 | 12/2005 | Ramkumar | | |
| 2007/0254548 | A1 * | 11/2007 | Meadows | B32B 5/06 | 442/387 |
| 2012/0131775 | A1 * | 5/2012 | Delecroix | B32B 18/00 | 28/107 |

OTHER PUBLICATIONS

Roberto A Lopez-Anido et al., Emerging Materials for Civil Infrastructure: State of the Art (2000) American Society of Civil Engineers, ISBN 0-7844-0538-7, p. 82.

Written Opinion of the International Searching Authority issued in Application No. PCT/US15/22641 dated Jun. 25, 2015.

* cited by examiner

METHOD AND APPARATUS FOR PRODUCING NONWOVEN MATERIALS

This application claims the priority of Provisional Patent Application No. 61/972,642 filed on Mar. 31, 2014.

BACKGROUND OF THE INVENTION

Field of the Invention

The present invention relates to the manufacture of nonwoven materials and, more particularly, to a new and improved method and apparatus for producing nonwoven materials of any suitable thickness and/or composition.

Description of the Background Art

At the present time, substantially all needle looms for producing nonwoven materials such as felt have a maximum opening between the stripper plate for the needles and the upper surface of the supporting bed having holes for receiving the needles of about 3½ inches. Accordingly, the maximum thickness of needle felts produced by existing needle looms is about 1¾ inches and the maximum density is about 170 oz per square yard of product. This is because the number and pattern of needles is limited for the reason that the present needle looms are constructed so that the needles pass through the product to be needled and into aligned openings in the upper surface of the supporting bed. The number and pattern of needles, therefore, is limited by the pattern of openings in the supporting bed.

Current needle looms are constructed so that the vertical movement of the needle bed is limited to 1 9/16 inches to 3 inches.

Also, the speed of the material being advanced through the current needle looms is limited by the fact that the needles extend through the material into the openings in the supporting bed. Because the needles enter the openings in the supporting bed, they are subject to breakage if, for some reason, they are not properly aligned with the openings in the support bed.

As a result of the current needle loom constructions, the production of needle felts or nonwoven materials is limited to materials of small thickness, such as 1¾ inches maximum and this limitation limits the uses of such needle felts or nonwoven materials.

A need has risen, therefore, for a new and improved method and apparatus for producing needle felts and other nonwoven materials that can be used for any suitable or desired applications. The present invention meets this need and allows the creation of any density or oz per sq yd to any thickness requirement above the standard needling of 170 oz per sq. yard and 1¾" thick. It also allows any desired or suitable synthetic fibers to be added to needle felts throughout the build, such as, e.g., ceramic fiber, high-purity alumina, zirconia, silica spun ceramic fibers or a base rayon viscose or cellulose base product prior to carbonization.

BRIEF SUMMARY OF THE INVENTION

In accordance with the present invention, a carded batt of any suitable material or combination of materials is advanced from a roll or in flat form on a feed apron into a needle loom that is constructed to vary the opening between the stripper plate or bed for the needles and the supporting bed for the batt to any suitable or desired size, e.g., a few inches to many feet as desired. As the batt is advanced through the needle loom, the needles in any suitable or desired pattern and density are reciprocated at any suitable or desired speed to penetrate the batt to tangle the fibers together and make the batt thinner, more compact and tighter as a result of the reciprocating movement of the needles generally in accordance with known technology. In the apparatus of the present invention, however, the needles do not extend completely through the batt into any holes in the supporting bed. Accordingly, the supporting bed may be of lighter construction, the needles may have limited lateral movement without worrying about breakage, and the reciprocating speed of the needles can be increased over the speed used in current needle looms. The needles may be of any suitable construction depending on the materials in the batt.

The distance between the stripper plate or needle bed and the support bed is adjusted to accommodate the thickness of the batt and the desired needle penetration thereof. The adjustment is accomplished by vertical movement of the support bed for the batt or vertical movement of the bed supporting the needles.

After the batt is needled and leaves the needle loom, it may be conveyed on a take up apron or the like to an apparatus for lifting the batt, turning it over to an inverted position and moving it again to the feed apron to be advanced into the same needle loom or another needle loom such that the batt is needled from the opposite side in both directions in a manner similar to that of the first needle penetration of the batt.

Thereafter, the double needled batt is removed from the needle loom by a suitable take up apron or the like and is moved to a position wherein it can be fed to the same or a different needle loom. Before advancing the double needled batt into the needle loom, another batt of any desired or suitable material is positioned on the double needled batt, the distance between the stripper plate or needle bed and the support bed of the needle loom is increased and the two batts in overlapped relation are advanced through the needle loom wherein the reciprocating needles extend through the upper batt into the lower batt short of the supporting bed to connect the two batts together. After the overlapped batts are removed from the needle loom by a take up apron or the like, the overlapped batts may then be lifted, inverted and transported to a feed apron or the like for movement into the same or a different needle loom wherein they can be needled from both directions in a manner as hereinbefore described.

Within the scope of the present invention, any suitable or desired number of batts of any suitable material, density or thickness may be added in overlapping relation to a needled batt as described herein without inverting the needled batt or the overlapped batts so that they are needled together from one direction only and not from both directions. The new and improved method and apparatus of the present invention, therefore, may be used to produce layered batts of any suitable thickness that are needled from one and/or two directions in any desired manner.

Thereafter, in accordance with the present invention, any suitable number of batts can be added to the needled batts, the opening between the stripper plate or needle bed and the support bed can be adjusted accordingly and the overlapped batts can be moved and needled in any desired manner to produce a multilayered batt of any suitable thickness limited only by the construction of the needle loom and the size of the opening between the stripper plate or needle bed and the support bed thereof.

In accordance with the method and apparatus of the present invention, the feed apron, needle loom and take up apron and devices are constructed and operate to insure for each cycle of operation that the needle beam movement and the movement of the batt or overlapped batts into, through and out of the needle loom is uniform and does not vary in speed.

With the improved method and apparatus of the present invention, layered and needled felts or nonwoven materials of any suitable or desired thickness can be constructed of any suitable material or materials and can be used for any desired application wherein lightweight strong materials are required such as in space or aircraft applications or any other desired applications.

DETAILED DESCRIPTION OF THE INVENTION

Figure 1:
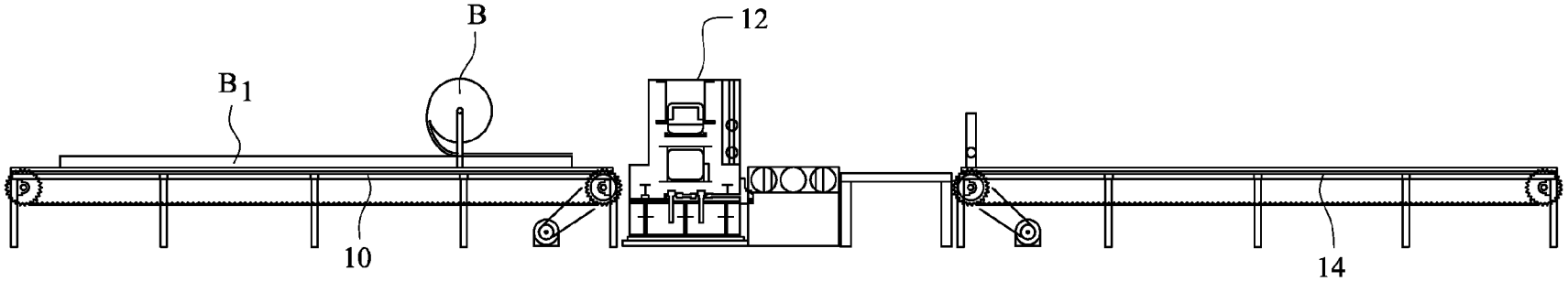
FIG. 1 is a schematic side elevational view of an apparatus for conveying a carded batt of one or more materials through a needle loom.

Referring to FIG. 1, a batt B is fed by a feed apron 10 into a needle loom 12 of any suitable construction wherein the batt is engaged by a predetermined number and pattern of reciprocating needles (not shown) for the purpose of compacting and tightening the fibers of the batt. The batt B is then removed from the needle loom 12 by a take up apron 14 and associated apparatus of any suitable construction for storage, shipping or further processing. In accordance with the present invention, the batt B may be positioned on a needled batt or overlapped batt layers $B_1$ that are positioned on the feed apron 10 for passage through the needle loom 12 in overlapped relation, as will be further explained in more detail hereinafter.

Figure 2A:
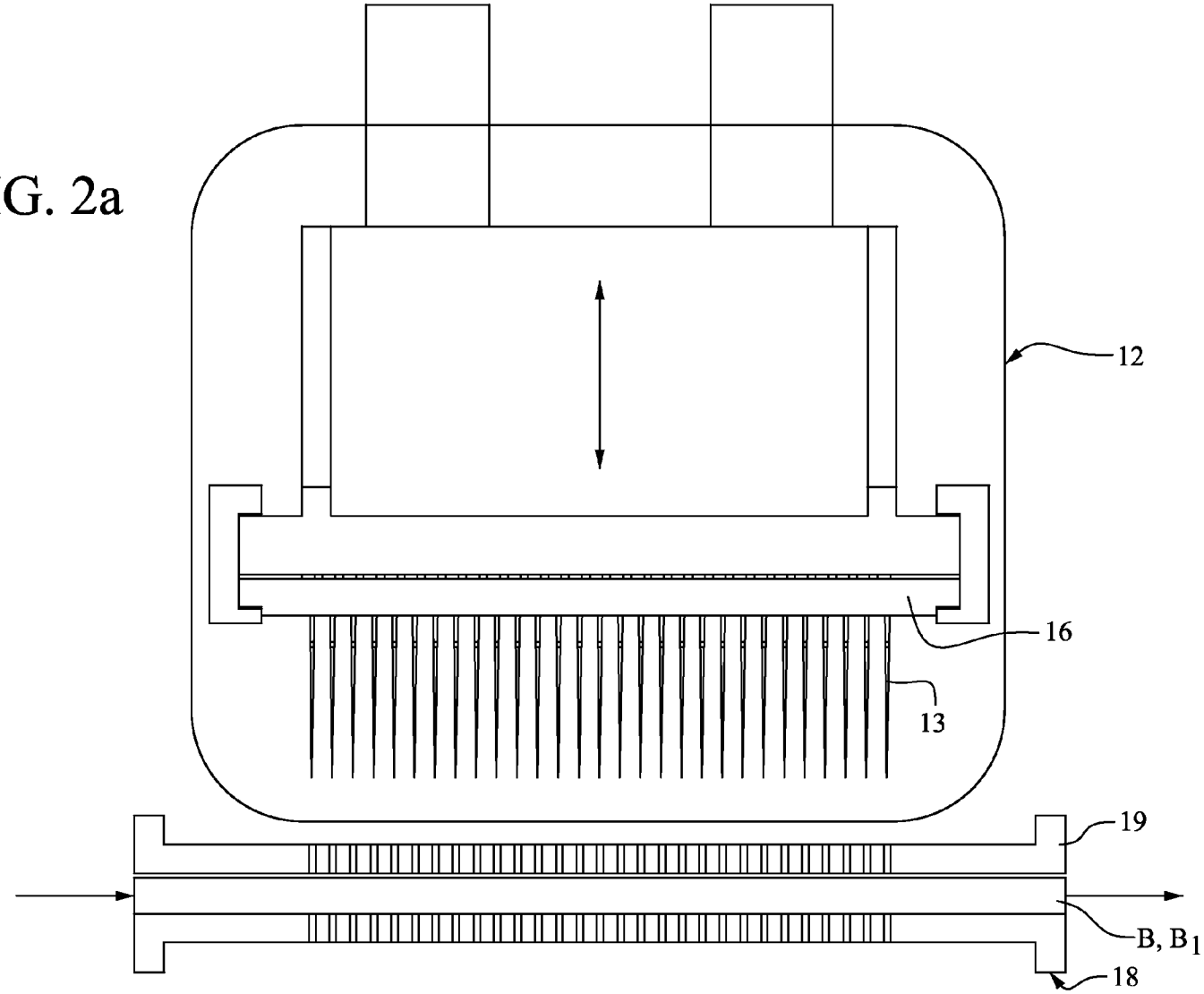
FIG. 2*a* is an enlarged schematic side elevational view of a portion of an apparatus for conveying one or more layers or batts of a selected material or materials through a needle loom in accordance with the present invention, showing the needle bed at the upper end of its reciprocating movement.
Figure 2B:
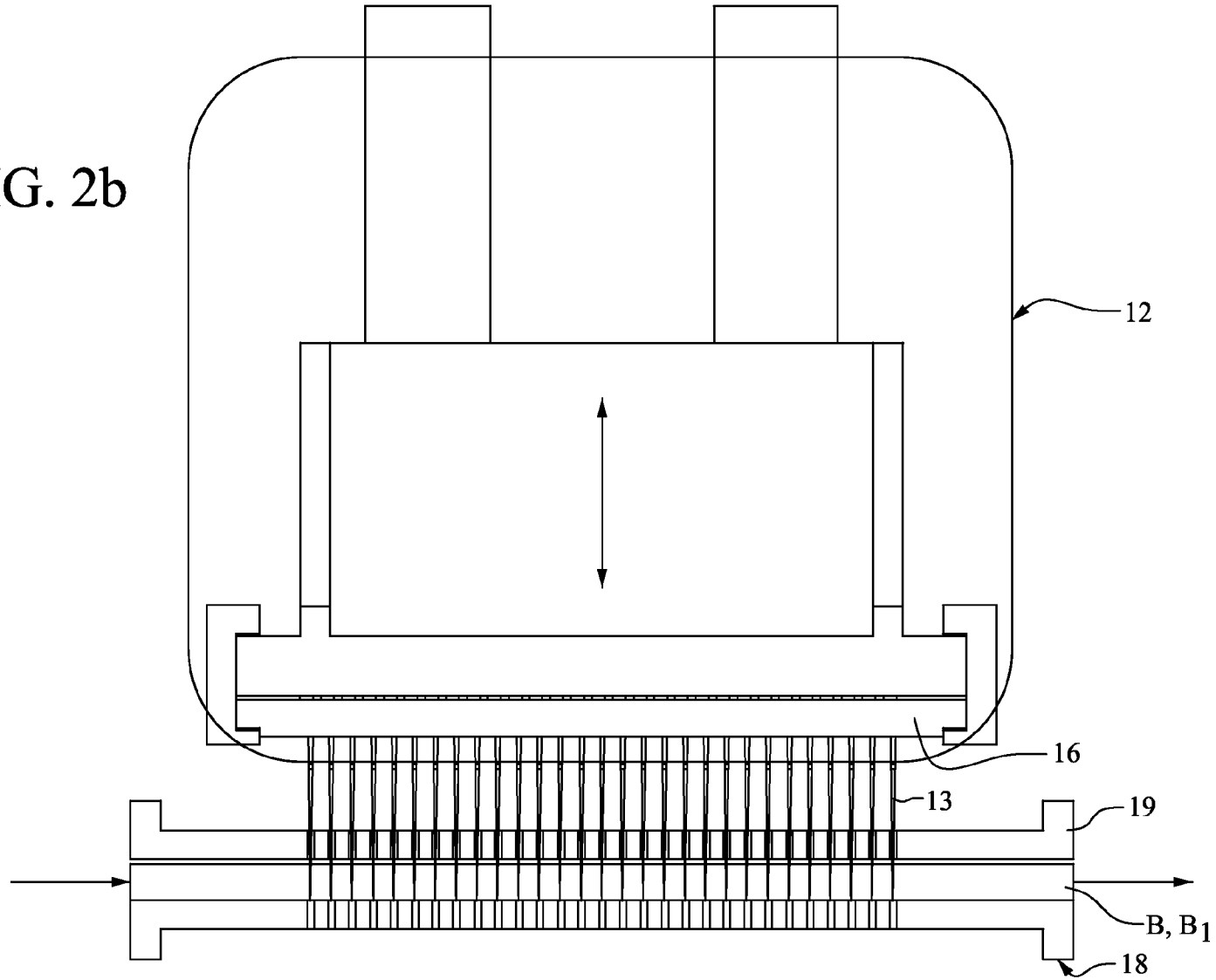
FIG. 2*b* is a side elevational view similar to FIG. 2*a* showing the needle bed at the lower end of its reciprocating movement.
Figure 3:
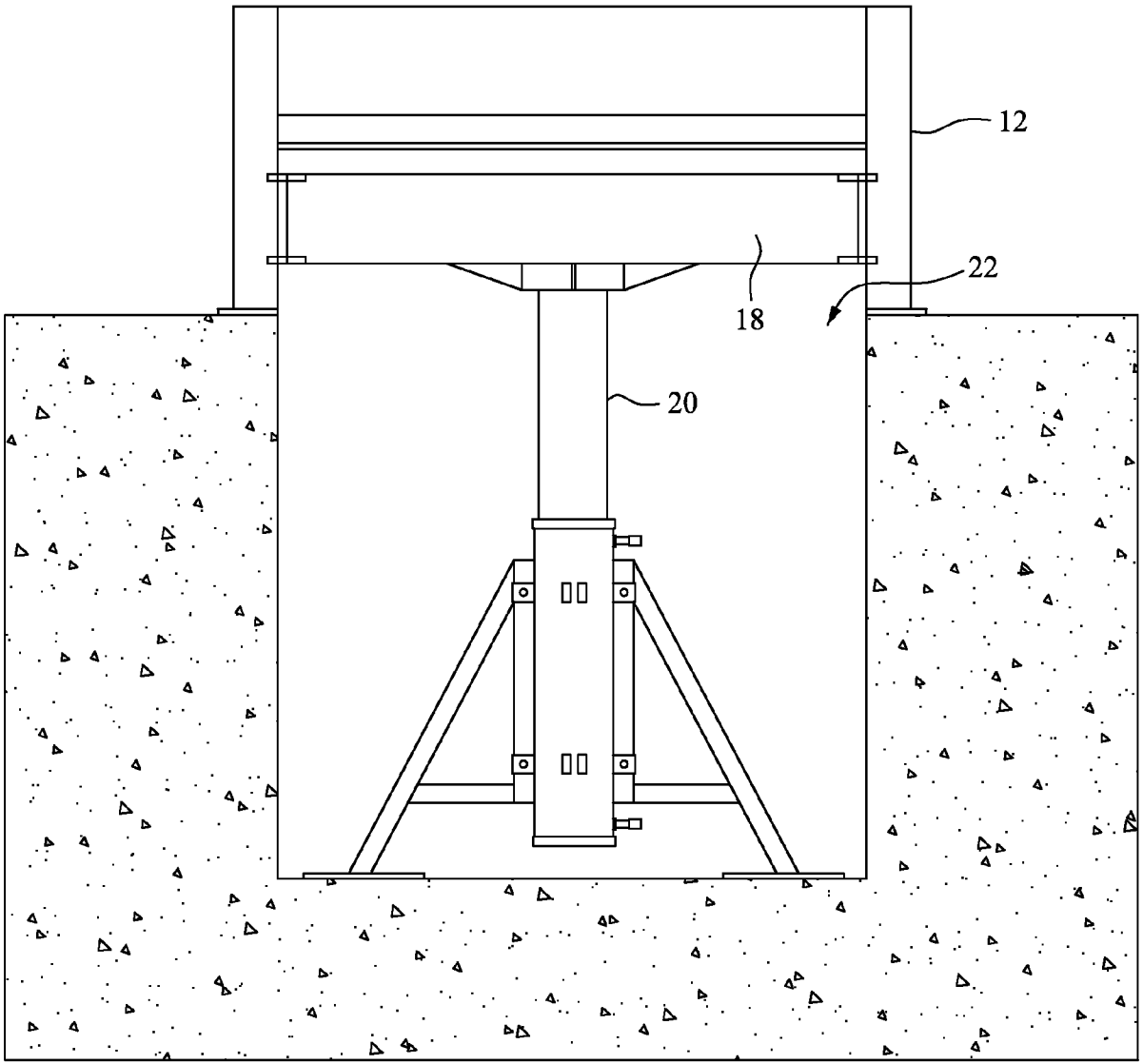
FIG. 3 is a side elevational view of one embodiment of a movable support bed for the apparatus shown in FIGS. 2*a* and 2*b;*

As shown schematically in FIGS. 2*a* and 2*b*, the new batt B and/or the underlying needled batts $B_1$ can be conveyed through the needle loom 12 wherein they are engaged by needles 13 on a vertically reciprocating needle bed 16 and are supported by a bed 18 that is vertically movable by a hydraulic device or any other suitable device to vary the spacing between the support bed 18 and the stripper plate 19 to accommodate one or more layers of batts to be needled of different thicknesses. In accordance with one embodiment of the invention, a hydraulic cylinder 20 may be located in a pit 22 of any suitable size or depth that is positioned beneath the needle loom 12 and operates to move the support bed 18 vertically, as shown in FIG. 3.

Referring to FIG. 2*b*, on the down stroke of the needle bed 16, the needles 13 pass through the stripper plate 19 and penetrate the batt B or batts $B_1$. As will be explained hereinafter, in accordance with the present invention, the needles 13 do not enter the support bed 18.

Figure 4:
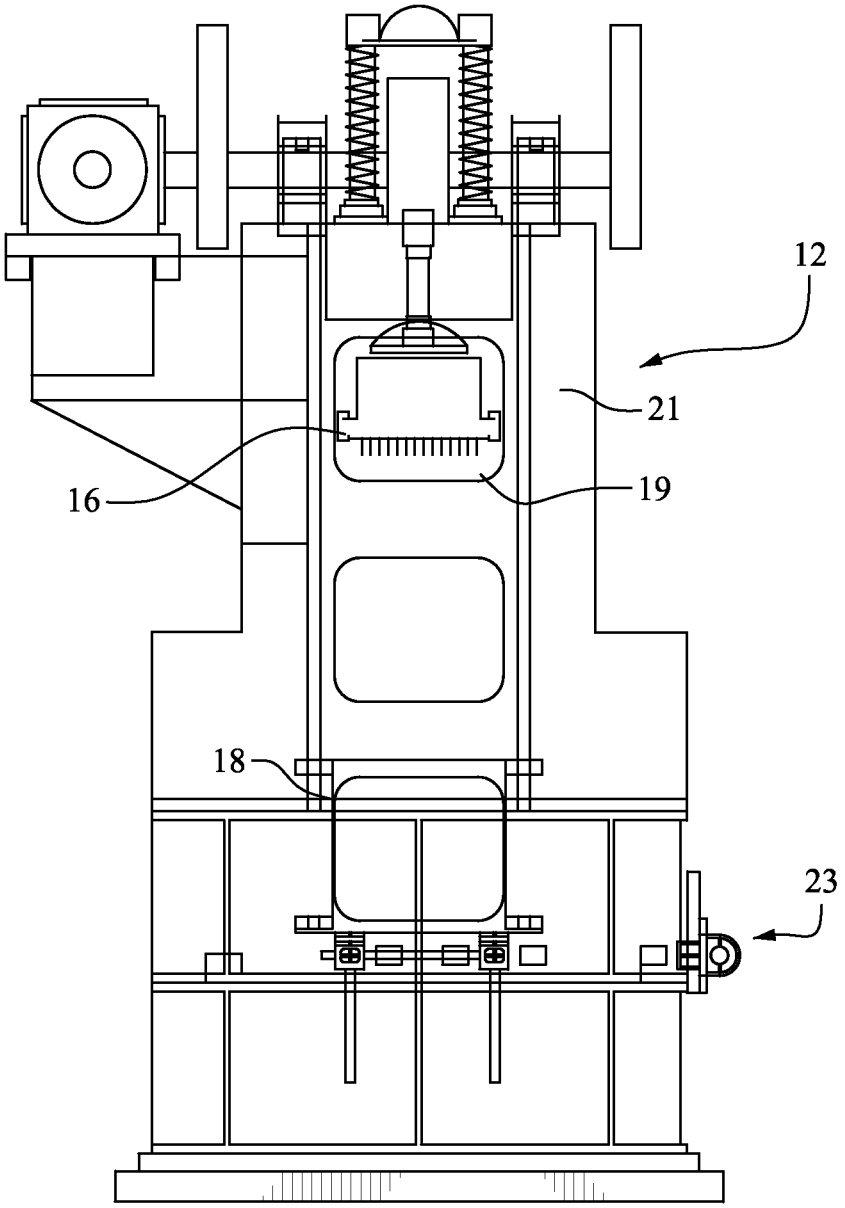
FIG. 4 is a side elevational view of a portion of a needling apparatus showing another embodiment of a movable support bed.
Figure 5A:
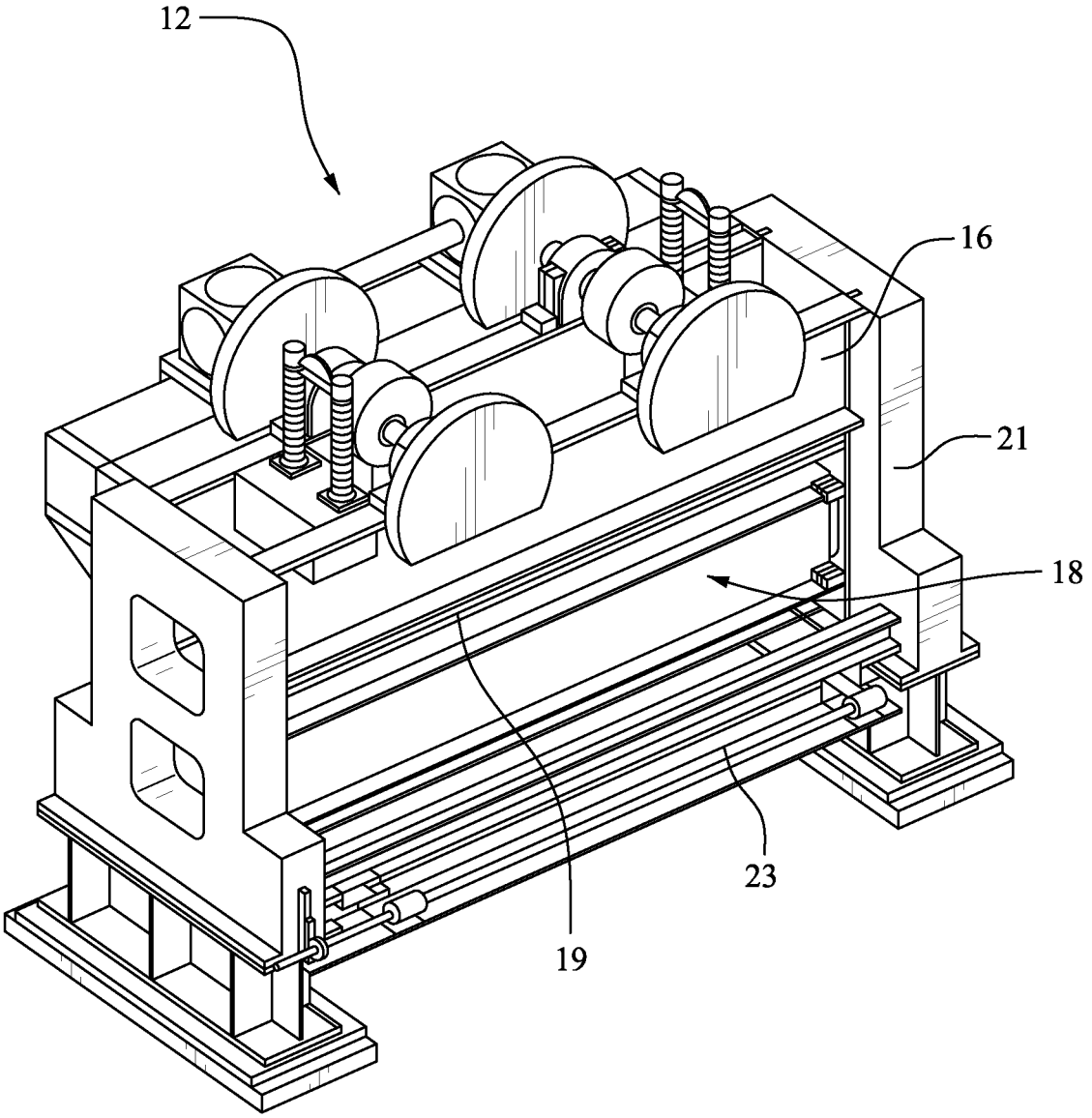
FIG. 5*a* is a perspective view of one embodiment of a needle loom with a movable support bed like the one shown in FIG. 4.
Figure 5B:
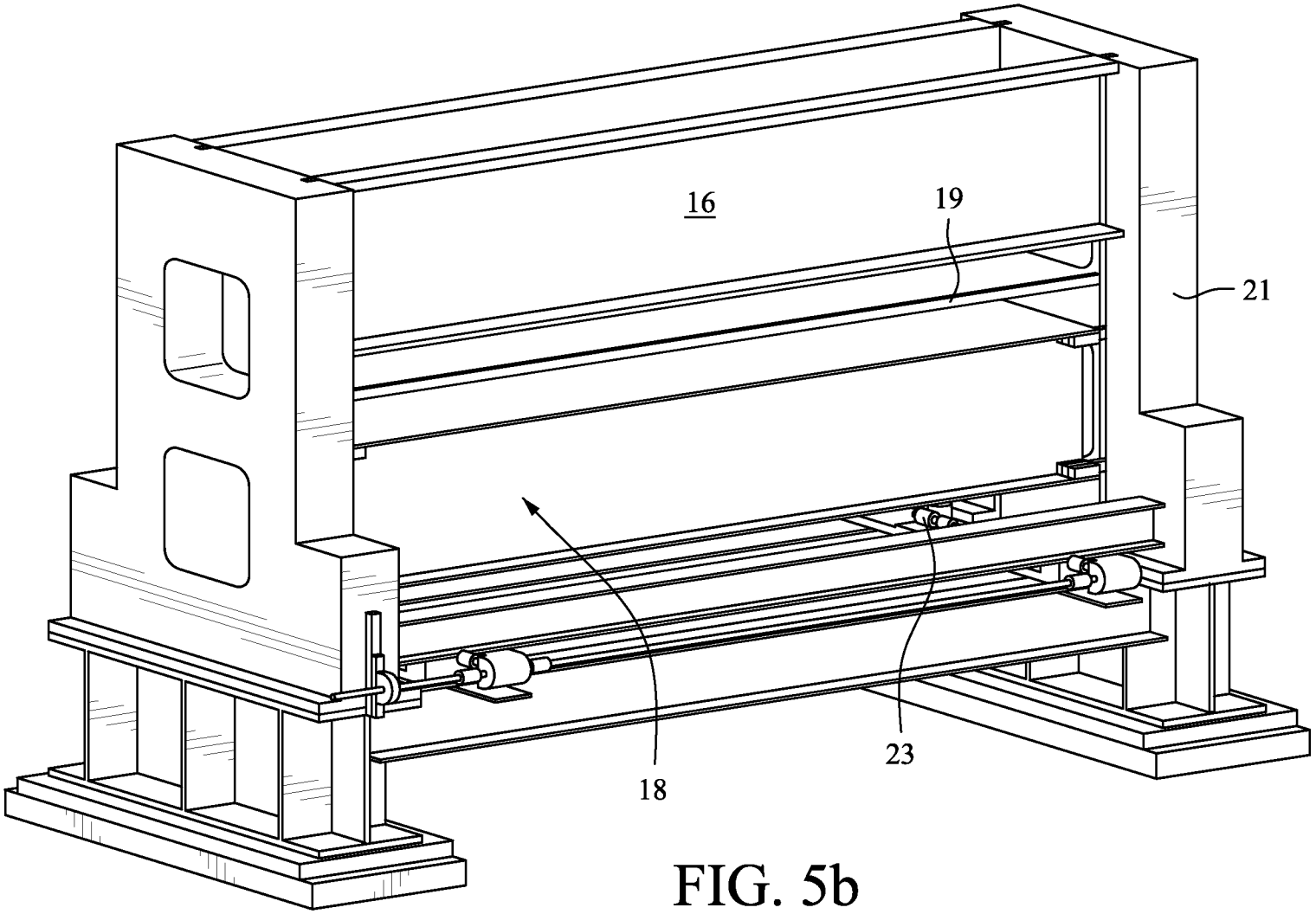
FIG. 5*b* is an enlarged perspective view of a portion of the needle loom shown in FIG. 5*a;*

In accordance with another embodiment of the invention shown in FIGS. 4, 5*a* and 5*b*, the support bed 18 is slidably mounted on the frame 21 of the needle loom 12 for vertical movement in relation to the needle bed 16 and stripper plate 19. The needle bed 16 is mounted on the frame 21 for limited vertical reciprocating movement thereon. The frame 21 is fixed in position on the floor and thus is not movable to vary the spacing between the needle bed 16 or stripper plate 19 and the support bed 18. A jack support system 23 of any suitable construction mounted on the frame 21 is connected to the support bed 18 and is operable mechanically or hydraulically to vary the spacing between the support bed 18 and the stripper plate 19 up to about two feet.

Figure 6:
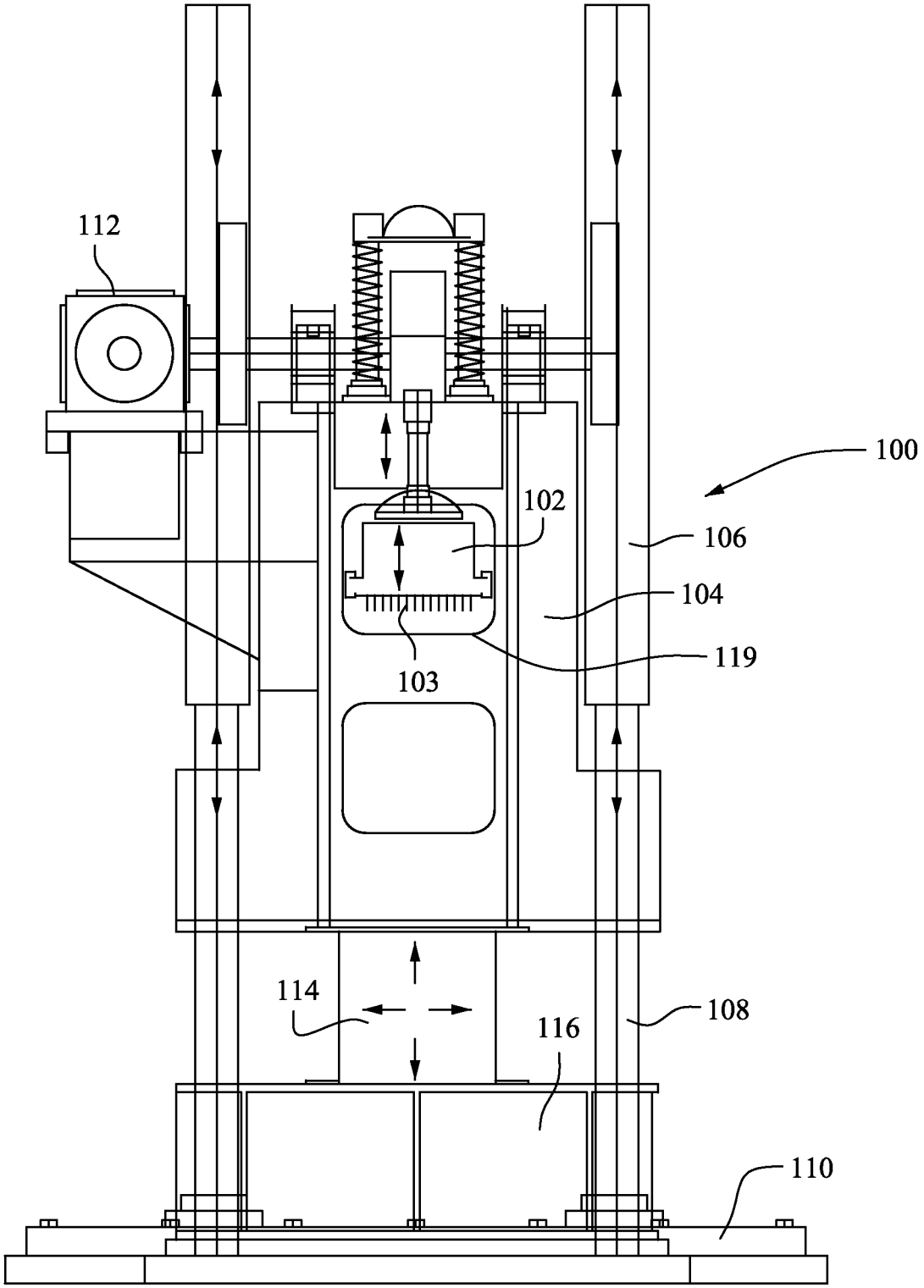
FIG. 6 is a side elevational view of a portion of a needling apparatus showing a further embodiment wherein the support bed is fixed and the needle bed and associated portions of the apparatus are movable.
Figure 7:
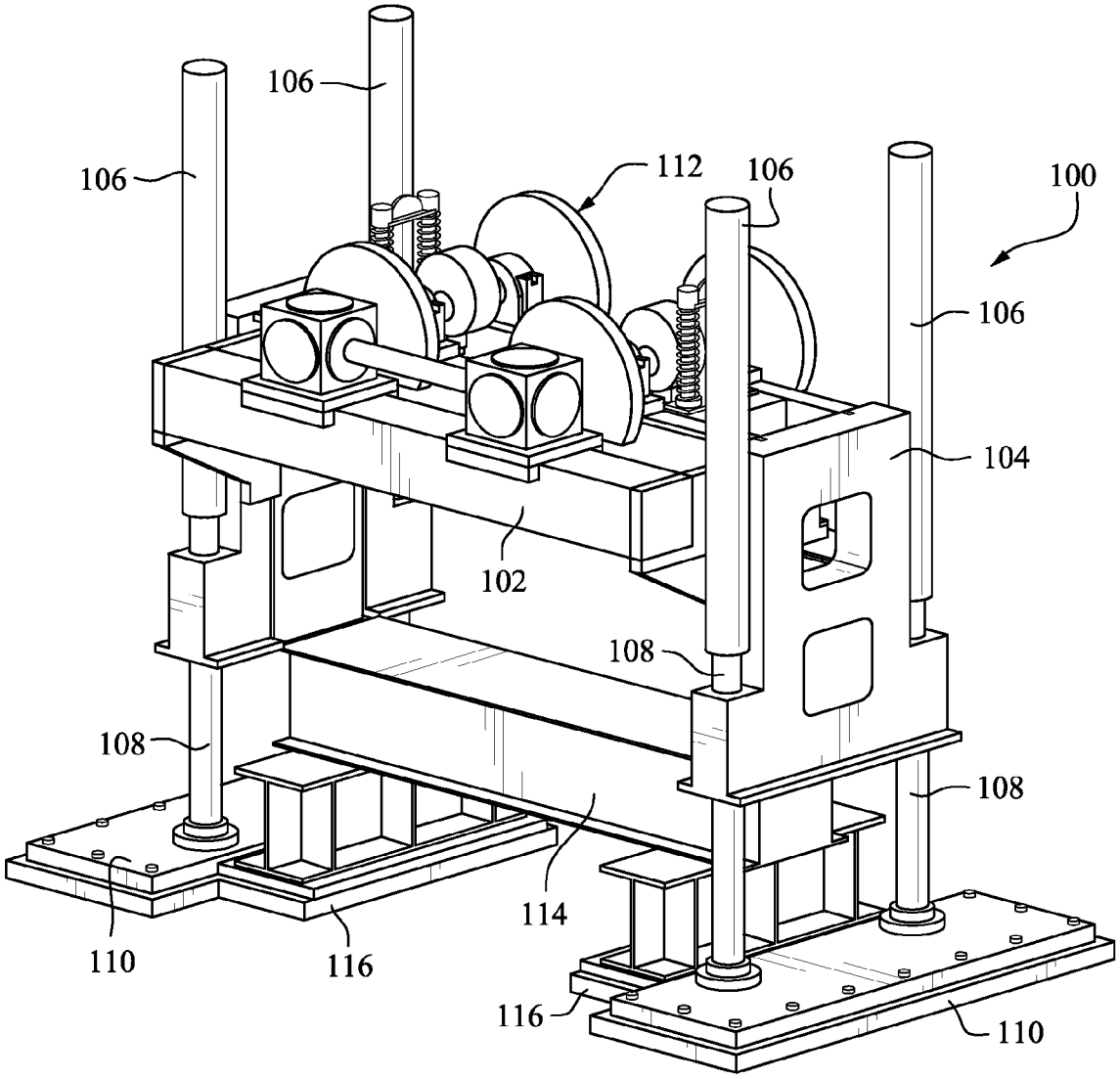
FIG. 7 is a perspective view of a further embodiment of a needle loom having a movable needle bed like that shown in FIG. 6.

FIGS. 6 and 7 illustrate a further embodiment of the present invention wherein a new and improved needle loom 100 comprises a needle bed 102 that is mounted for reciprocal movement on the frame 104 secured to a plurality of vertically extending legs 106 that are telescopically mounted on vertically extending supports 108 secured to base pads 110 that include any suitable type of shock absorbing devices. The legs 106 are vertically movable on the supports 108 by any suitable type of hydraulic or mechanical drive means (not shown).

The upper portion of the needle bed 102 comprises a suitable type of drive apparatus 112 for the vertical reciprocal movement of the needle bed 102 and needles 103 connected thereto.

A support bed 114 is positioned under the needle bed 102 and is fixedly mounted on base girders 116 of any suitable type.

The sturdy construction of the needle loom 100 enables the vertical spacing between the support bed 114 and the stripper plate 119 to be varied a significant amount, e.g., up to ten feet or more, by vertical movement of the frame 104 secured to the support legs 106 that are vertically movable on the supports 108. This construction also minimizes any vibration that may occur from reciprocating movement of the needle bed 102. In cases where the needle loom 100 is constructed for significant vertical spacing between the support bed 114 and the needle bed 102, additional support legs 106 and supports 108 may be provided on the needle loom 100.

Figure 8:
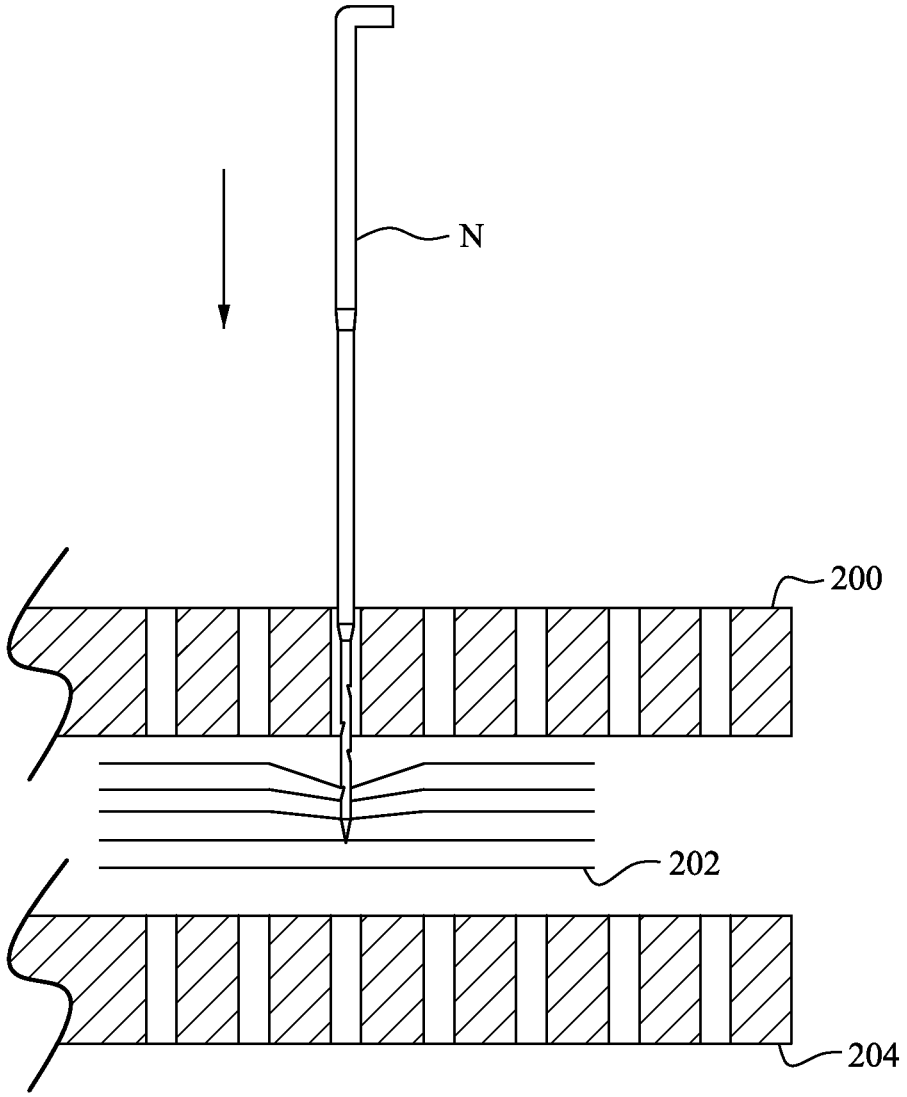
FIG. 8 is a schematic view of a needle from a needle loom extending through a stripper plate on its down stroke into the fiber of one or more batts in a needle loom of the present invention.
Figure 9:
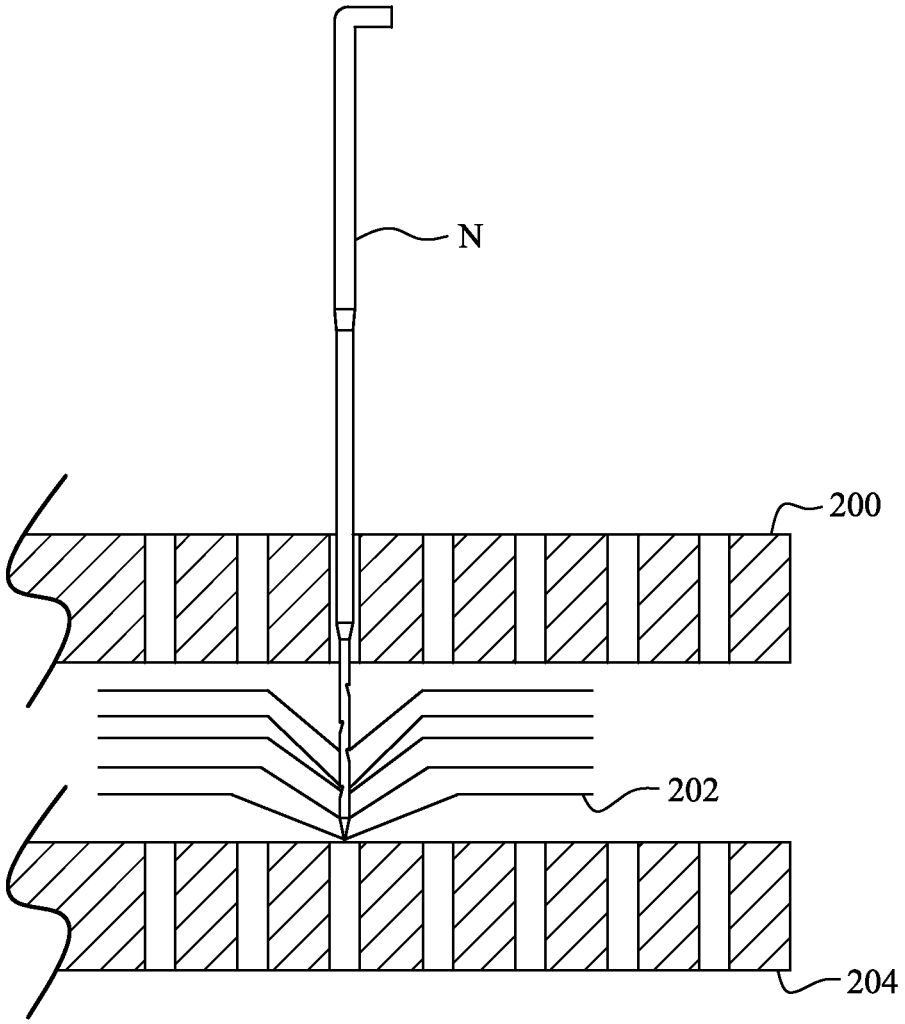
FIG. 9 is a view similar to FIG. 8 showing the needle at the bottom of its stroke through the batt.
Figure 10:
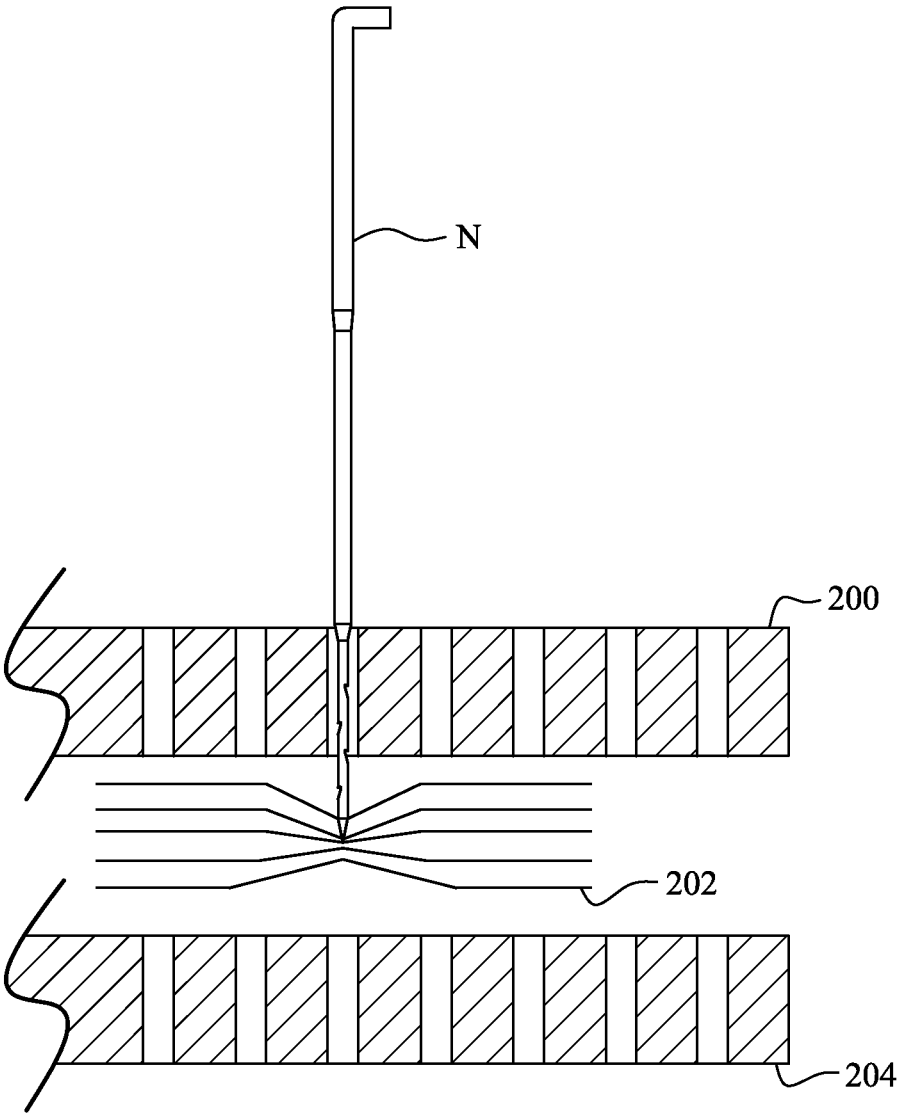
FIG. 10 is a view similar to FIGS. 8 and 9 showing the needle on its upstroke through the fiber of the batt.

FIGS. 8-10 illustrate schematically the reciprocating movement of a needle in accordance with the principles of the present invention. As shown in FIG. 8, on the down stroke of a needle N of any suitable or desired construction, the needle extends through an aligned aperture in a stripper plate 200 of a needle loom (not shown) and engages the fibers of a batt 202 formed of one or more layers being advanced between the stripper plate 200 and the support bed or plate 204 of any suitable construction. During the downstroke of the needle N, fiber gathers inside of barbs on the needle that continue to grab strands of fiber and draw them down towards the support bed 204. At the bottom of the stroke of the needle N, as shown in FIG. 9, the needle stops short of the support bed 204 and therefore does not enter into the plane of the support bed 204 in accordance with the present invention. In this manner, the support bed 204 may be of simple lightweight construction without any apertures therethrough and the needle N may be free to move laterally to a limited extent in any direction without any danger of breakage by not being aligned with apertures in the support bed 204. Depending on the type of needle N used in the needle loom and the type of fibers in the batt 202, the use of a stripper plate 200 on the needle loom (not shown) may not always be necessary.

On the upstroke of the needle N as shown in FIG. 10, the fibers of the batt 202 begin to tangle together, the thickness of the batt 202 is reduced and the batt becomes more compact and tighter. As more needle penetrations occur, the tightness of the batt will increase and its thickness will decrease up to a certain point which is controlled by the penetration depth of the needle, the number of barbs on the needle, and the number of penetrations of the needle.

Figure 11A:
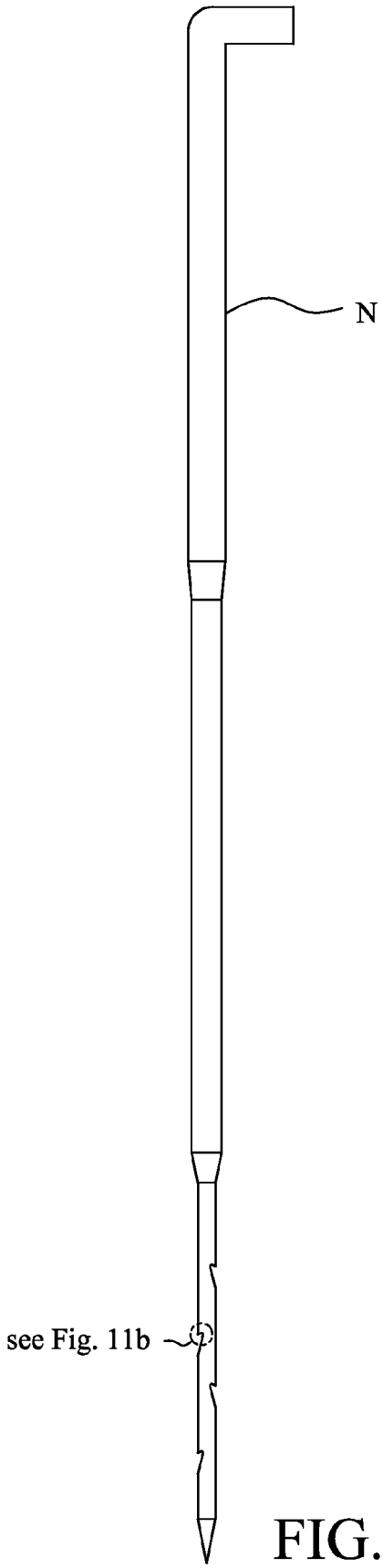
FIG. 11*a* is a side elevational view of one embodiment of a needle for use in the needle loom of the present invention.
Figure 11B:
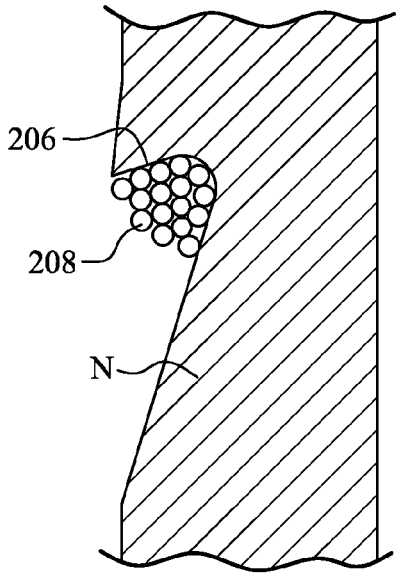
FIG. 11*b* is an enlarged side elevational view in section of a portion of the needle shown in FIG. 11*a;*

FIGS. 11*a* and 11*b* illustrate one example of a needle N that may be used in a needle loom constructed in accordance with the present invention. The needle N comprises a plurality of barbs 206 in its lower portion that grab strands of fibers 208 and push them downwardly on the downstroke of the needle N through a batt being advanced between a stripper plate and a support bed of a needle loom.

In accordance with the present invention, any suitable needle construction may be used in a needle loom depending on many factors such as the composition and thickness of the batt or layers of batts being advanced through the needle loom and the depth and reciprocating speed of penetration of the needles into the moving batt.

FIGS. 12-20 illustrate different embodiments of an apparatus 300 for performing the new and improved method of the present invention comprising the following basic steps:

1. Advancing a carded batt of a selected material or materials through a needle loom between the stripper plate and support bed of a needle loom which is constructed in accordance with the present invention to vary the vertical spacing between the stripper plate and support bed a significant amount to accommodate a batt or layers of batts of significant thickness, e.g., up to ten feet or more;
2. Adjusting the vertical spacing between the stripper plate and the support bed for a predetermined penetration of the batt or layers of batts by the needles on the needle bed;
3. Limiting the downward movement of the needles on the needle bed through the advancing batt such that the needles do not penetrate or contact the support bed which allows the needles to be mounted for limited lateral movement in any direction to reduce needle breakage;
4. Removing the needled batt from the needle loom onto a take up apron of any suitable construction;
5. Lifting the needled batt from the take up apron, and moving it in the same or an inverted position to a feed apron for the needle loom or another needle loom;
6. Advancing an inverted needled batt through the needle loom so that it is needled in the opposite direction and on the opposite side thereof;
7. Removing a double needled batt from the needle loom onto a take up apron and moving it again to a feed apron;
8. Positioning a second carded batt over a single or double needled batt on the feed apron and advancing and connecting the batts in overlapped relation through a needle loom which has been adjusted to increase the spacing between the stripper plate and the support bed to accommodate the increased thickness of the overlapped batts;
9. Moving the layered, needled and secured batts to the take up apron for the needle loom and lifting and moving them in the same or an inverted position to a feed apron for the same or another needle loom for a repeat of the same cycles as hereinbefore described which can be repeated a desired or selected number of times to produce a layered batt of any suitable thickness.

Referring to FIGS. 12-20, the apparatus 300 generally comprises a feed apron 302, a needle loom 304 or 304*a*, pinch rolls 306, a take up apron 308 and an overhead crane 310 that is movable longitudinally over the feed apron, needle loom and take up apron.

The feed apron 302 may be of any suitable construction and, in one embodiment of the present invention, comprises upstanding bars 312 for engaging the rear portion of a batt and overlying clamp arms 314 or the like for holding the batt on the feed apron 302 as will be more fully disclosed hereinafter.

The needle loom 304 may be of any suitable construction in accordance with the present invention, such as the construction shown in FIG. 5*a* or 7 wherein the vertical distance between the stripper plate and the support bed can be varied to a significant extent as hereinbefore explained.

The pinch rolls 306 may be of any suitable construction for advancing the needled batt or batts in a uniform manner onto the take up apron 308 which also may be of any suitable construction and may comprise movable clamp arms 316 for holding the batt B on the take up apron. To insure that a needled batt or batts of certain materials, such as viscose or cellulose fibers used in a carbon/carbonization process, are metal free, the apparatus 300 also comprises a magnet 307 and metal detector 309 positioned between the needle loom 304 and the take up apron 308.

Figure 15:
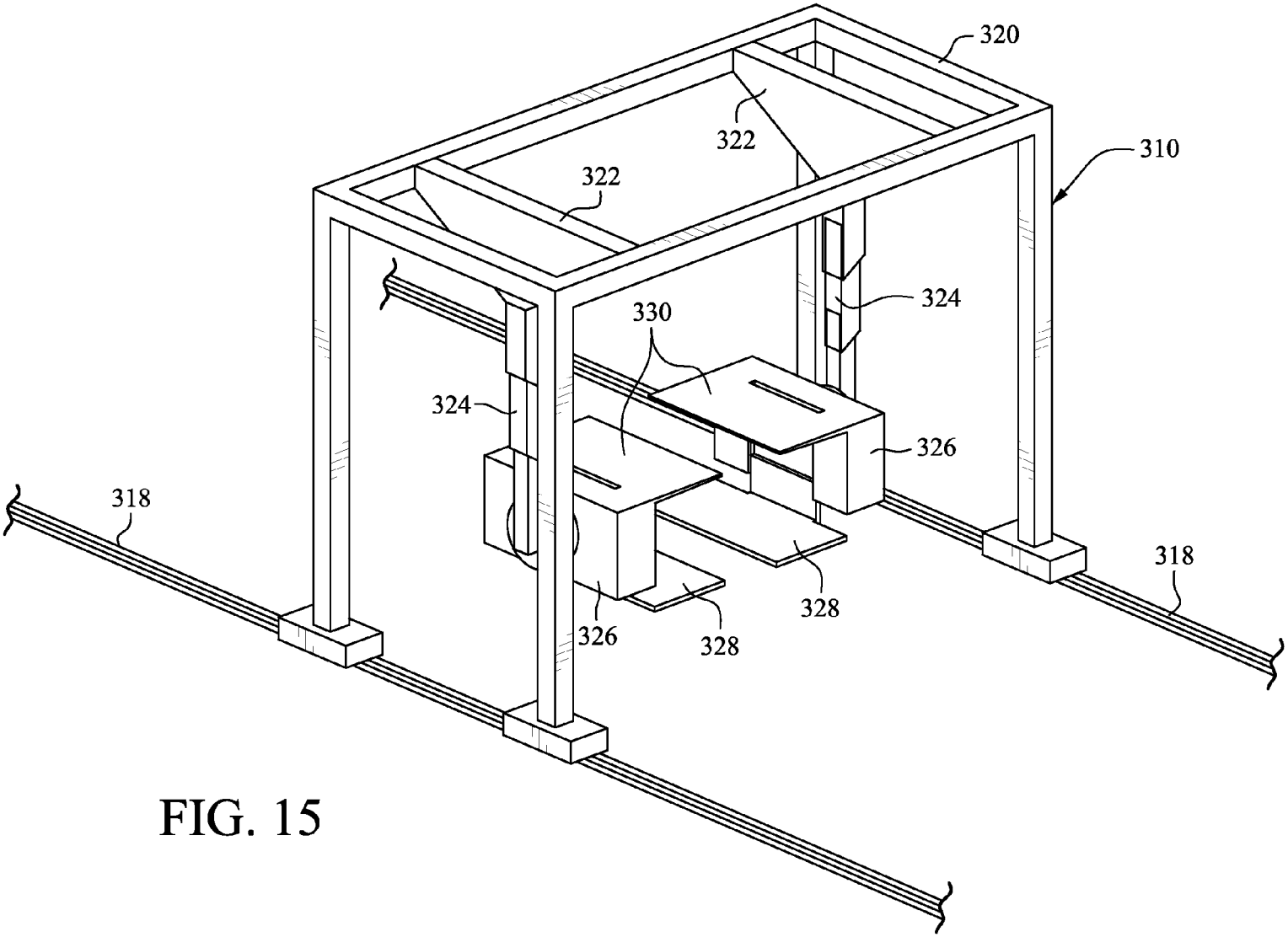
FIG. 15 is a perspective view of a crane for moving and/or inverting or turning over a needled batt or batts showing a track system for moving the crane.

As shown in FIG. 15, a crane 310 is longitudinally movable over the feed apron 302, the needle loom 304 and the take up apron 308 in any suitable manner, such as by mounting it for movement on a track 318 or the like. The crane 310 comprises a frame 320 having support arms 322 slidably mounted on the upper portion thereof for lateral movement. Each arm 322 comprises vertically moveable legs 324 having a clamp mechanism 326 rotatably mounted on the bottom portion thereof. The vertically movable legs 324 may be of any suitable construction, such as a telescoping construction, and may be movable by any suitable hydraulic or mechanical means (not shown).

Each clamping device 326 may be of any suitable construction to enable it to engage and pick up a batt or layered batts on the take up apron 308 when the crane 310 is positioned over the take up apron and to deposit them on the feed apron in the same or an inverted position when the crane is moved to a position over the feed apron.

In an illustrative embodiment, each clamp mechanism 326 comprises an inwardly extending fixed bottom plate 328 and an inwardly extending top plate 330 that is vertically movable with respect to the bottom plate 328.

Figure 12:
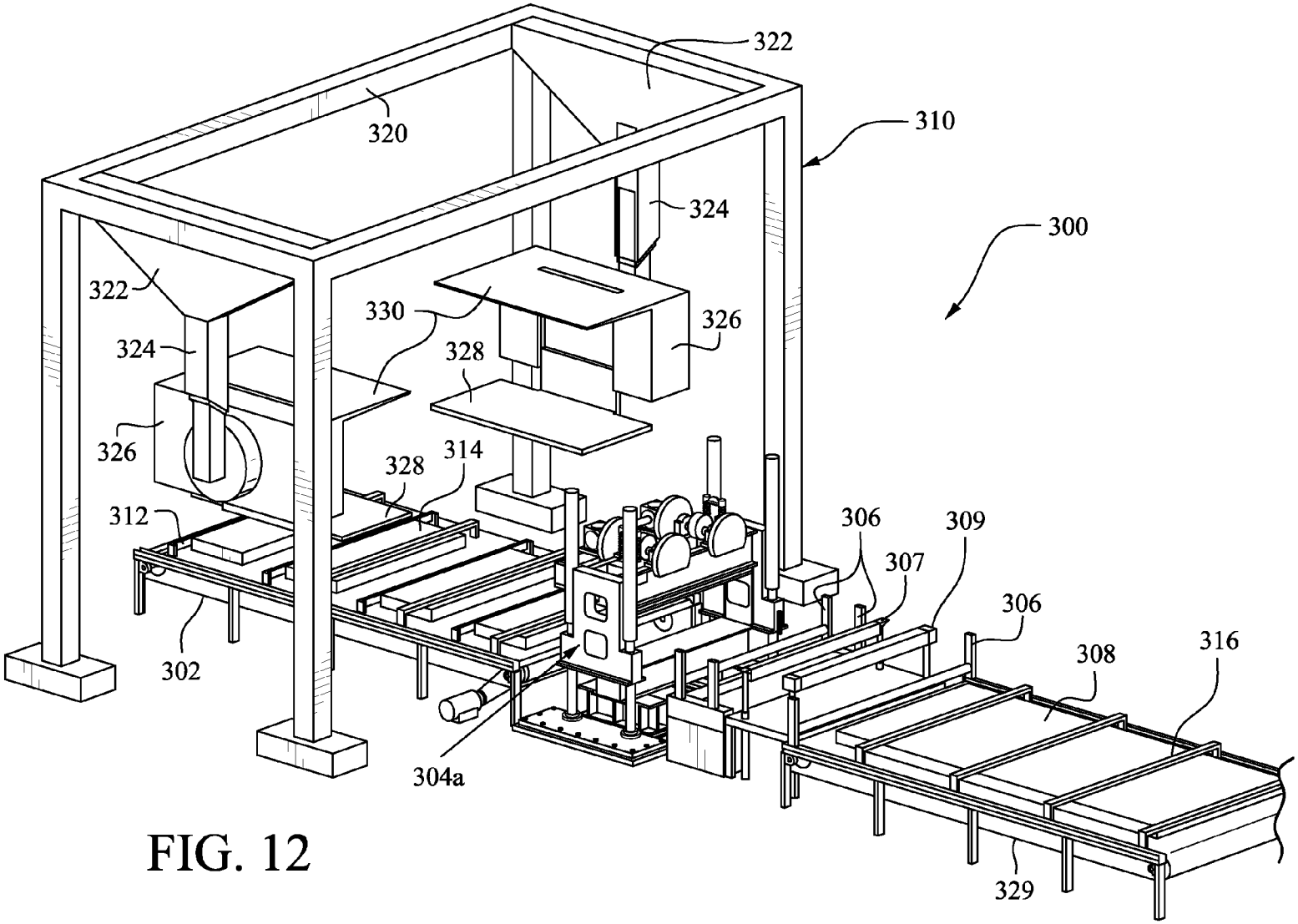
FIG. 12 is a perspective view of an apparatus for conveying a batt or layers of batts through a needle loom with a movable needle bed and for lifting a needled batt or layers of batts exiting the needle loom and conveying them to a feed apron in an inverted or another position so that they can be again conveyed through the needle loom.
Figure 13:
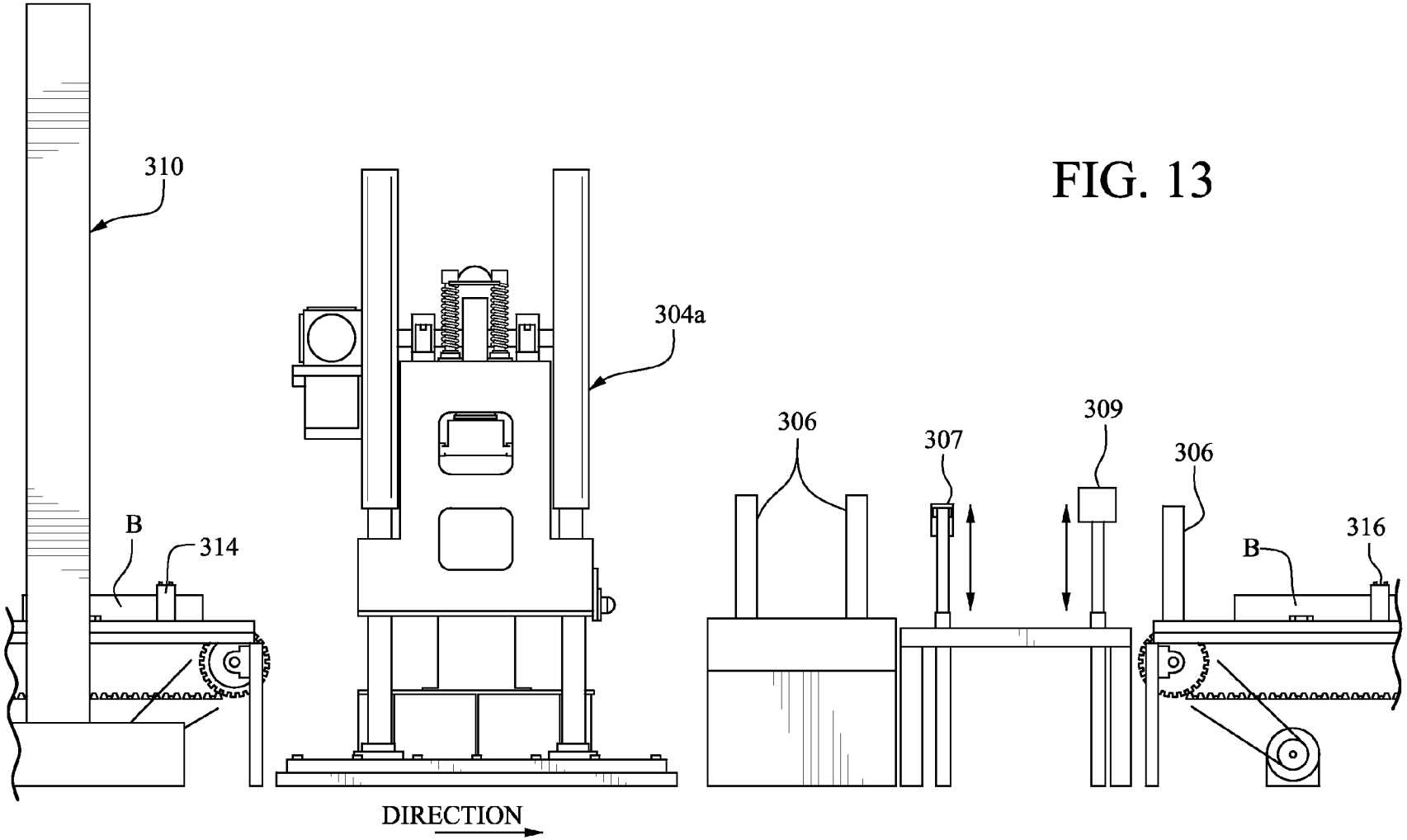
FIG. 13 is a side elevational view of a portion of the apparatus shown in FIG. 12.
Figure 14:
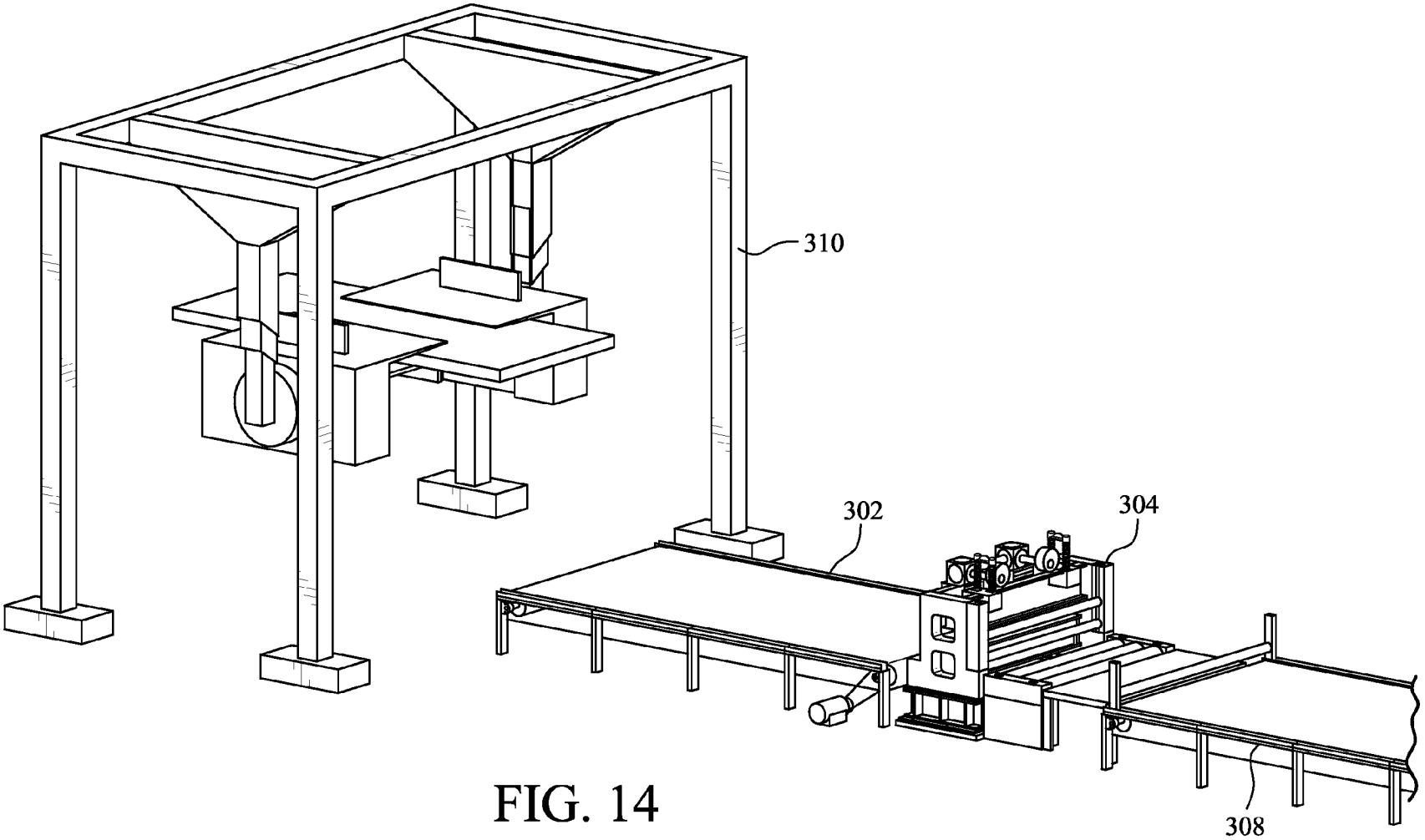
FIG. 14 is a perspective view similar to FIG. 12 of an apparatus for conveying a batt or batts through a needle loom having a movable support bed.
Figure 16:
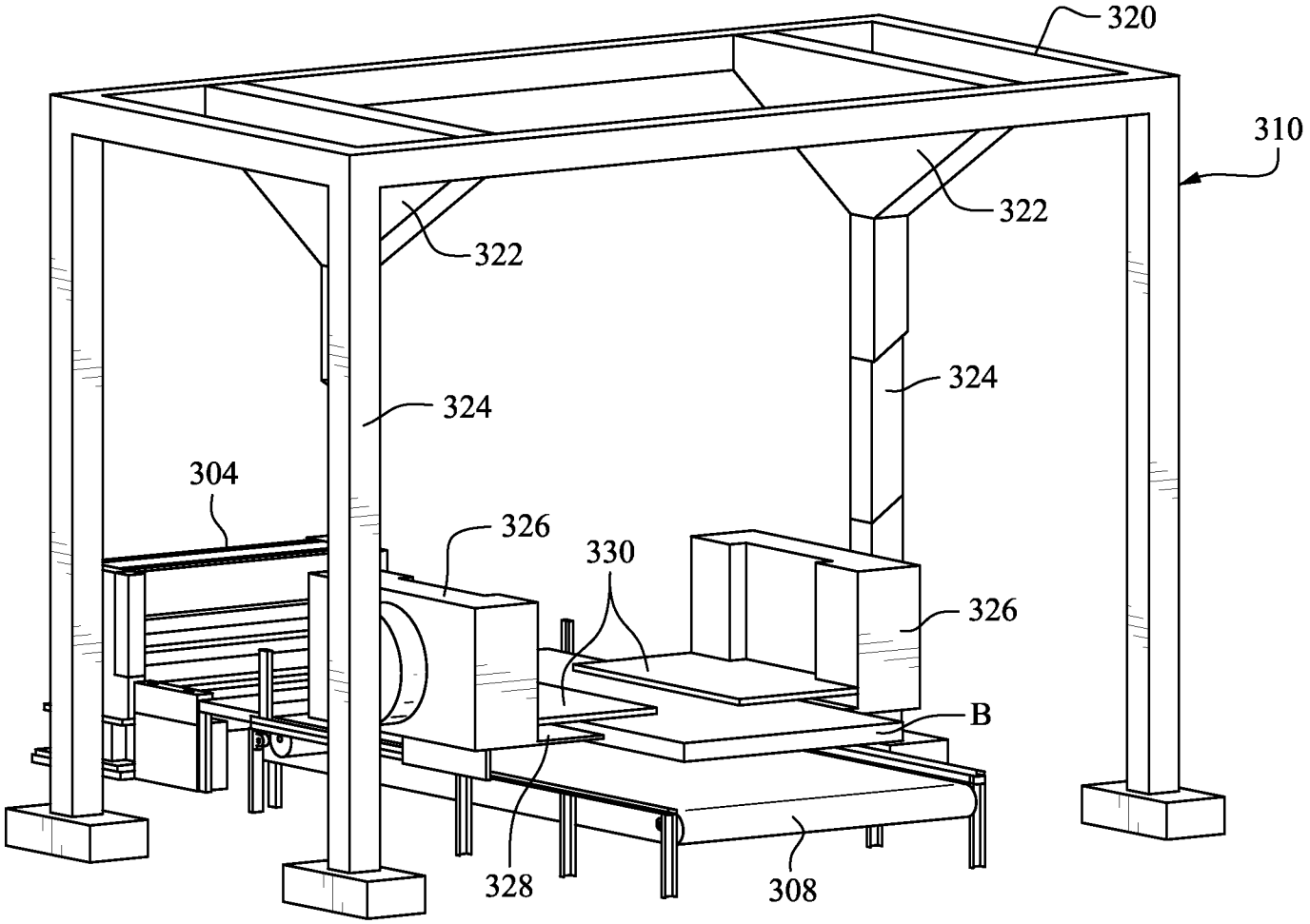
FIG. 16 is a perspective view of a portion of the apparatus shown in FIG. 14 wherein the crane is positioned to pick up a needled batt or batts from the take up apron.
Figure 17:
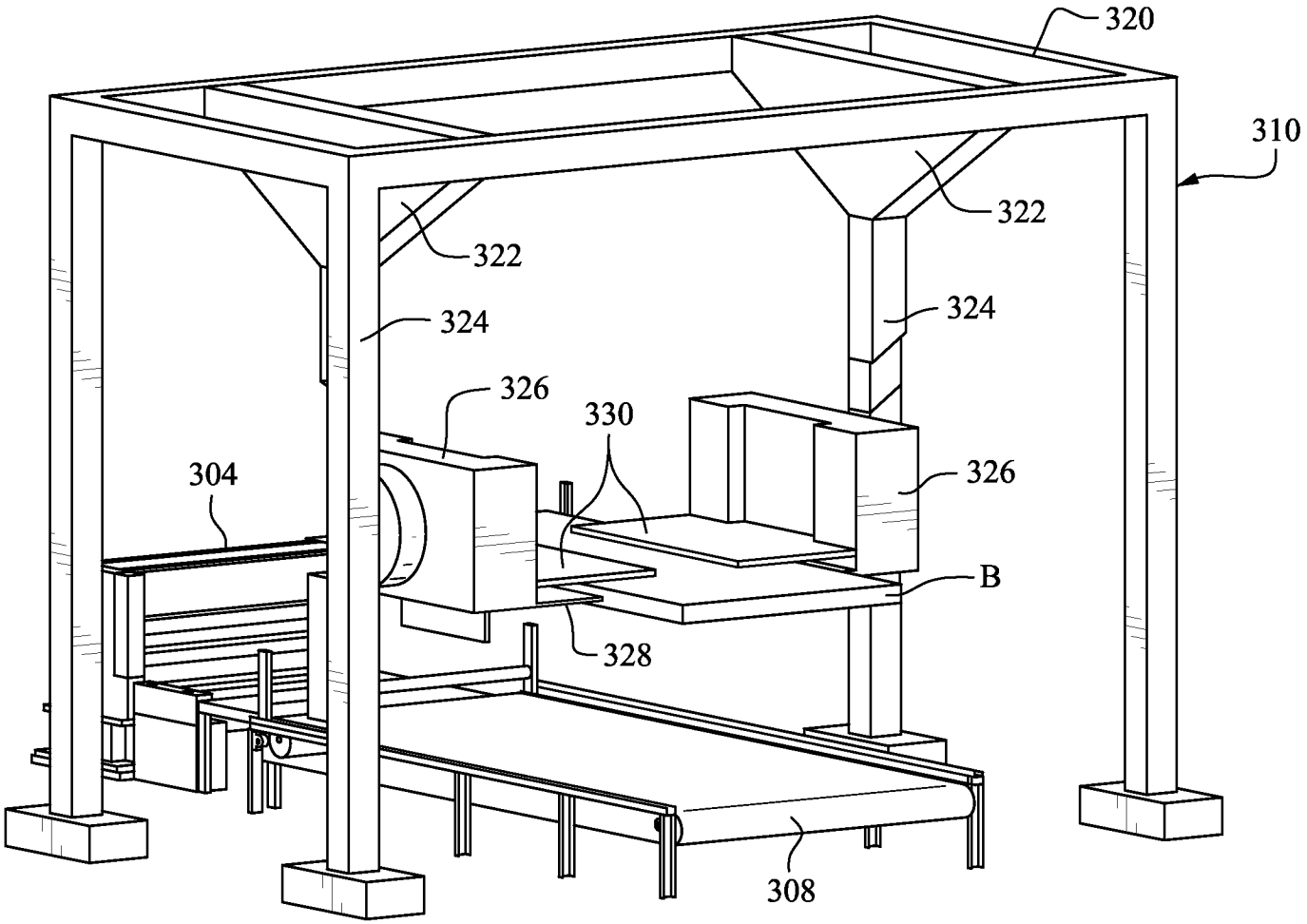
FIG. 17 is a perspective view similar to FIG. 16 wherein the crane has lifted the needled batt or batts from the take up apron.

In the operation of the apparatus 300 in accordance with the method of the present invention, the crane 310 is movable over the take up apron 308 to engage and pick up a needled batt or layers of batts B that have been moved onto the take up apron 316 from the needle loom 304, as shown in FIG. 12. This is accomplished by moving the support arms 322 outwardly, moving the support legs 324 downwardly so that the fixed bottom plate 328 of each clamp device 326 can be inserted under the adjacent batt or layers of batts on the take up apron 308, moving the support arms 322 inwardly to insert the fixed bottom plates 328 under the batt or layers of batts B, moving the top plates 330 downwardly into engagement with the top of the batt B and moving the support arms 324 upwardly to lift the batt B upwardly from the take up apron 308, as shown in FIGS. 16 and 17.

Figure 18:
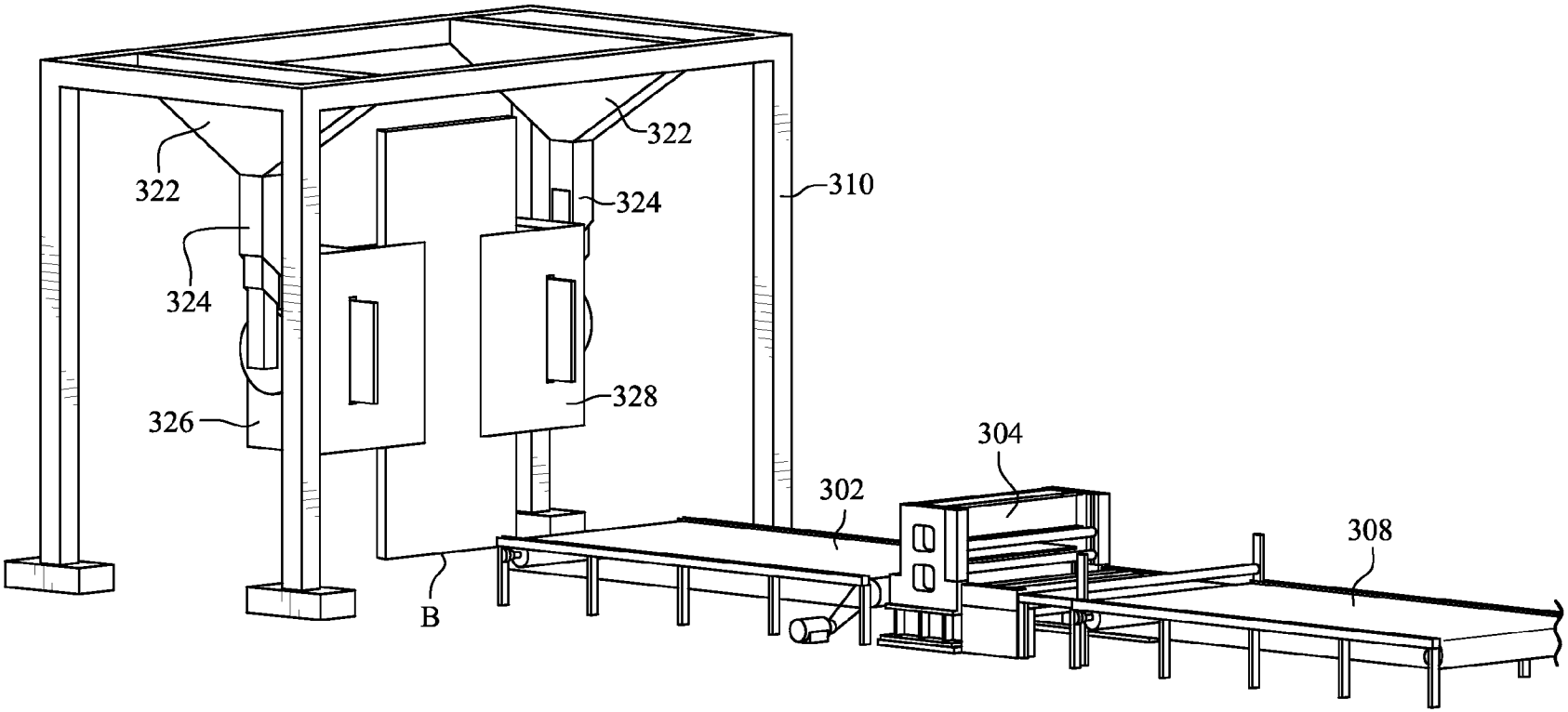
FIG. 18 is a perspective view of a portion of the apparatus shown in FIG. 14 showing the crane at the beginning of the feed apron with the needled batt or batts supported on the crane being rotated to be inverted.
Figure 19:
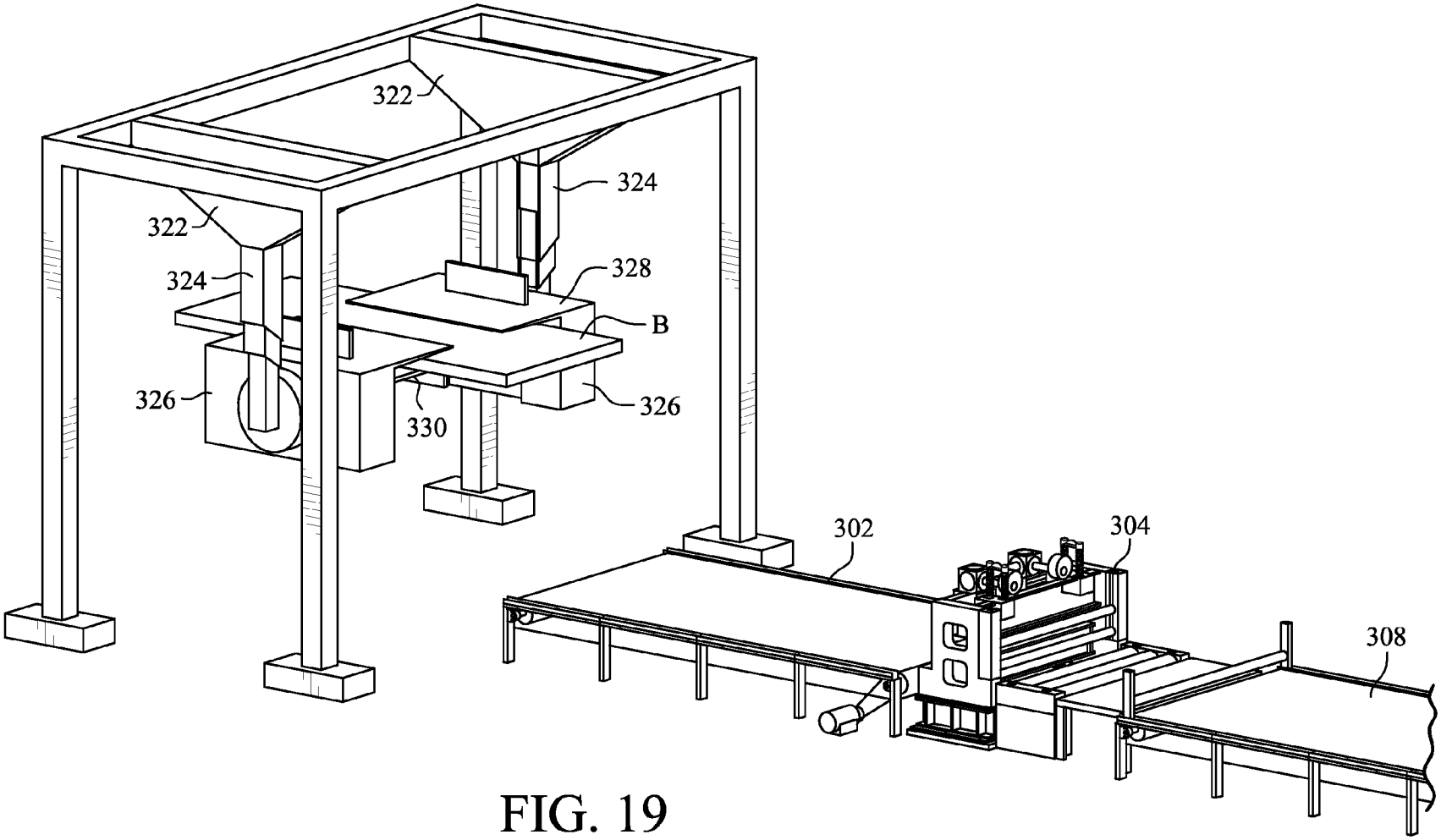
FIG. 19 is a perspective view similar to FIG. 18 showing the needled batt or batts supported by the crane being turned over completely.

The crane 310 is then moved to a suitable position wherein the clamp devices 326 may be rotated approximately 180° on the support legs 324 when it is desired to invert or turn the supported batt B over on its opposite side as shown in FIGS. 18 and 19.

Figure 20:
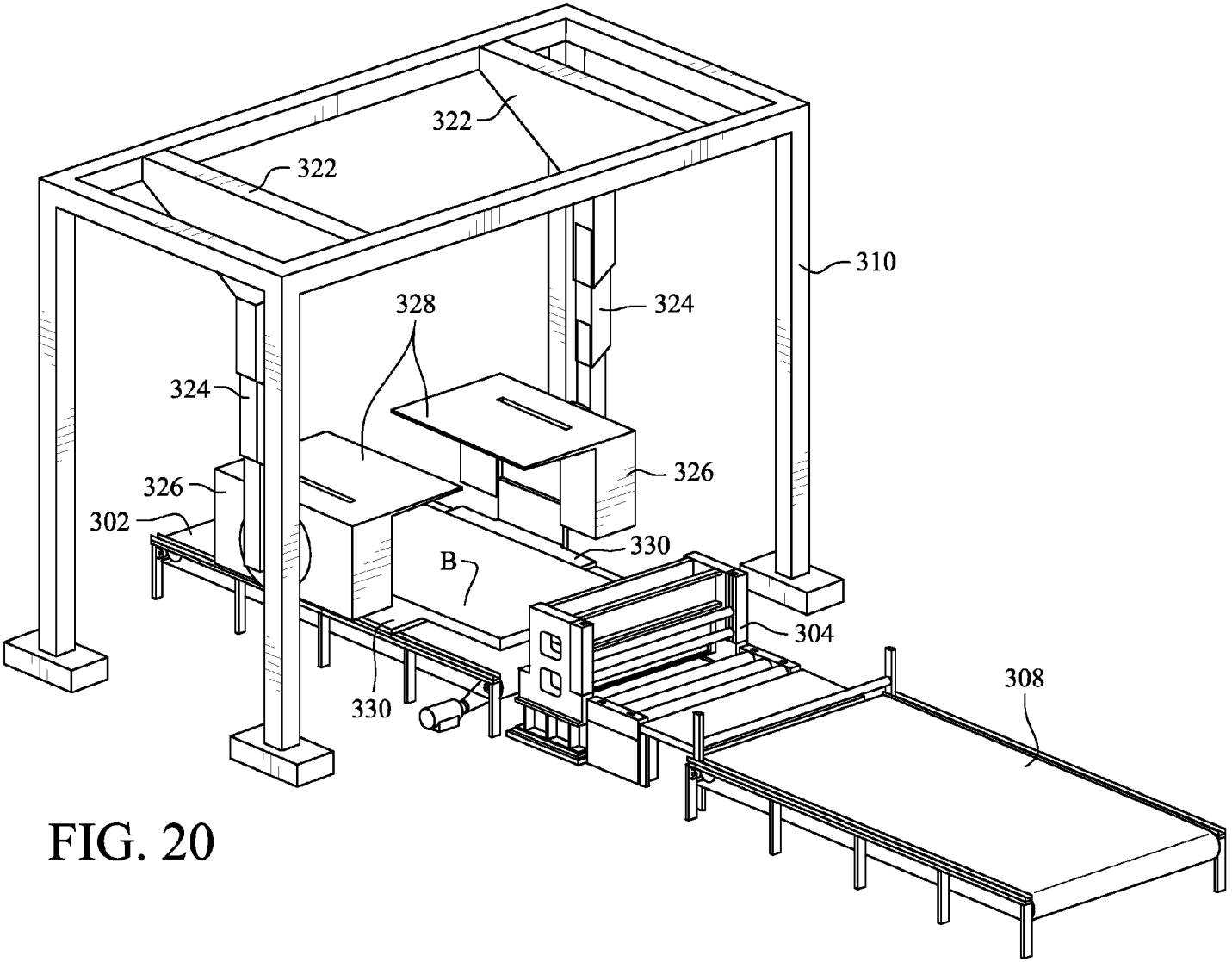
FIG. 20 is a perspective view similar to FIGS. 18 and 19 wherein the turned over or flipped needled batt or batts are again positioned on the feed apron for movement into the needle loom for additional needling in the opposite direction and on the opposite side thereof.
Figure 21:
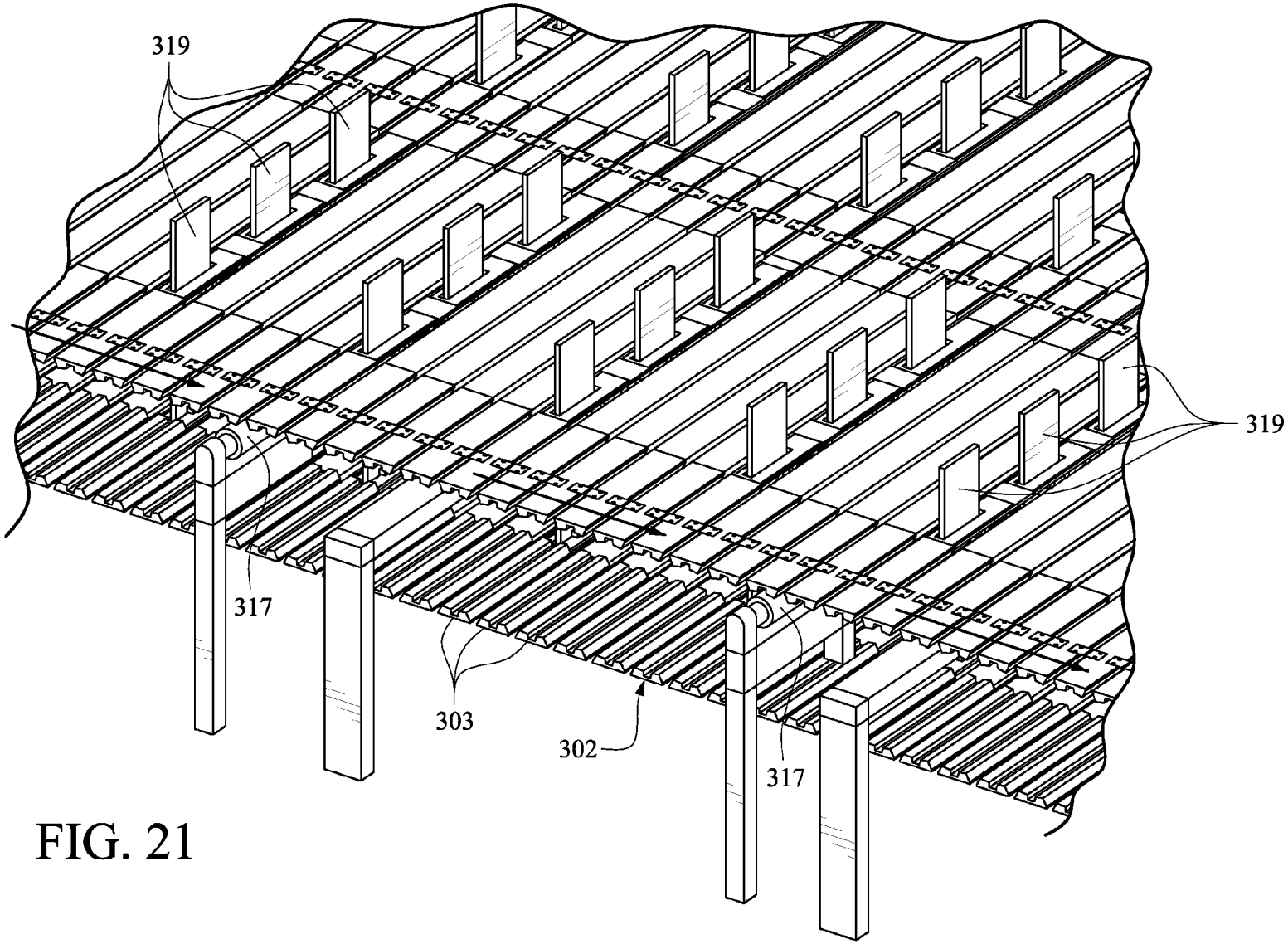
FIG. 21 is a perspective view of a portion of a feed apron or conveyer for a needle loom in accordance with the present invention.

Thereafter, as shown in FIG. 20, the crane 310 is moved to a position over the feed apron 302, the support arms 324 are moved downwardly to position the movable plates 330 on the clamp devices 326 on the feed apron 302, the movable plates 330 are moved away from the fixed plates 328 of the clamp devices 326, the support arms 322 are moved laterally outwardly to remove the movable plates 330 from the supported batt B so that the batt B rests on the feed apron 302 in the same or an inverted position. An inverted batt B can then be advanced into the needle loom 304 so that it is needled in the opposite direction and also on the opposite side.

The described operation of the apparatus 300 can then be repeated in the manner shown in FIGS. 12-20 to pick up batts or layers of batts from the take up apron 308 and deposit them in the same or an inverted position on the feed apron 302. In this manner, layers of batts B can be needled together in the same or different directions and on different sides, if desired, to produce a layered batt of any desired thickness and composition, and the spacing between the stripper plate and the support bed of the needle loom 304 can be increased to accommodate the increases in thickness of the layered batts, as hereinbefore described.

For the operation of the method and apparatus of the present invention, it is essential that a batt or layered batts be moved into, through and out of the needle loom at a constant speed. To accomplish this, the apparatus of the present invention comprises a new and improved feed apron, take up apron and associated devices.

Referring to FIGS. 12 and 21-24*c*, the feed apron 302 is formed of slats 303 that are connected by hinges 305 and have longitudinal grooves 311 on the inner surfaces thereof that are engaged by teeth 313 on supporting end rollers 315 for moving the feed apron 302 between and over the end rollers 315. The feed apron 302 is supported at its upper portion by a plurality of support rollers 317.

Figure 22:
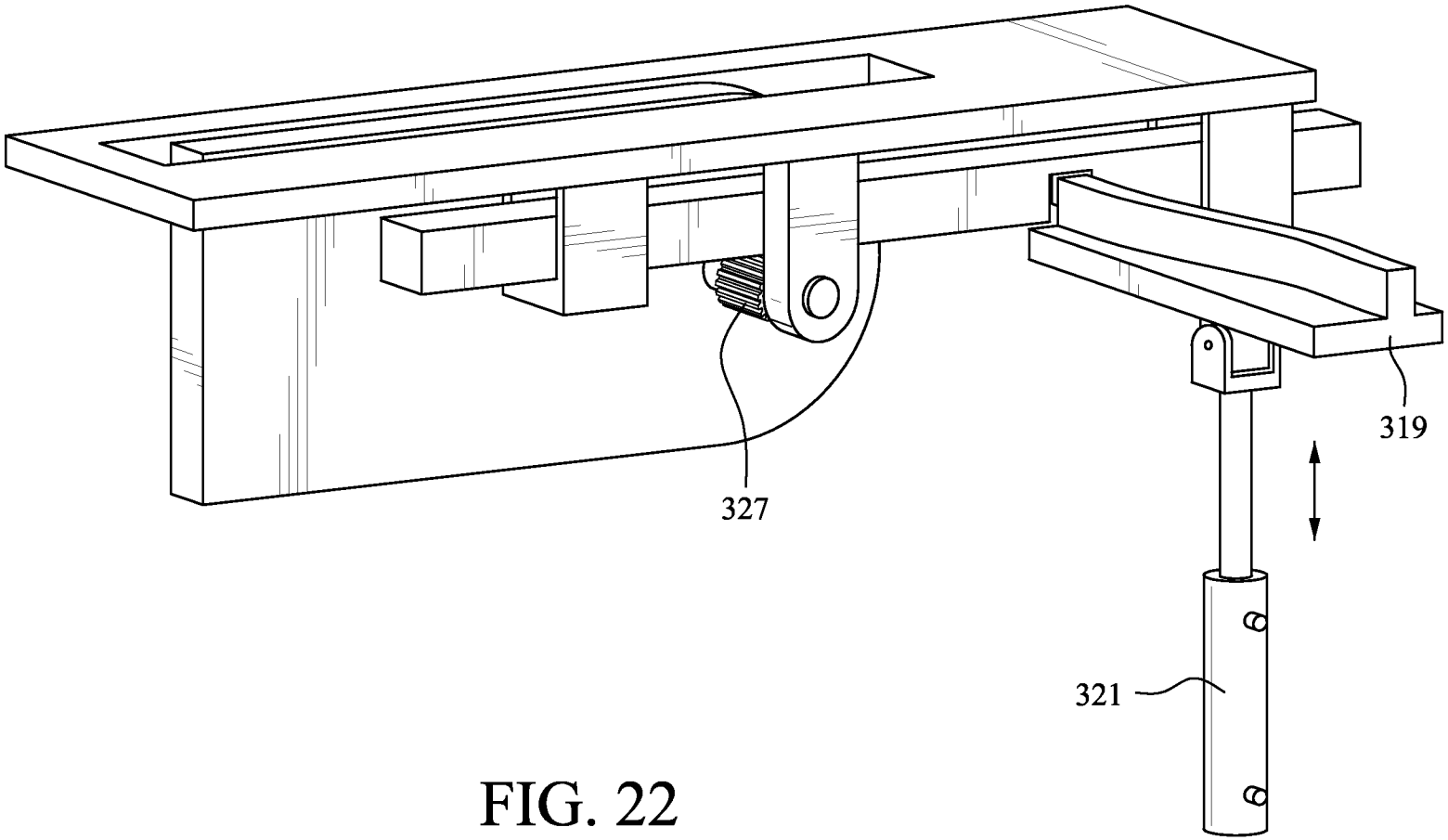
FIG. 22 is a perspective view of a portion of the feed apron shown in FIG. 21 showing a holding or pushing rail and associated operational devices.
Figure 23:
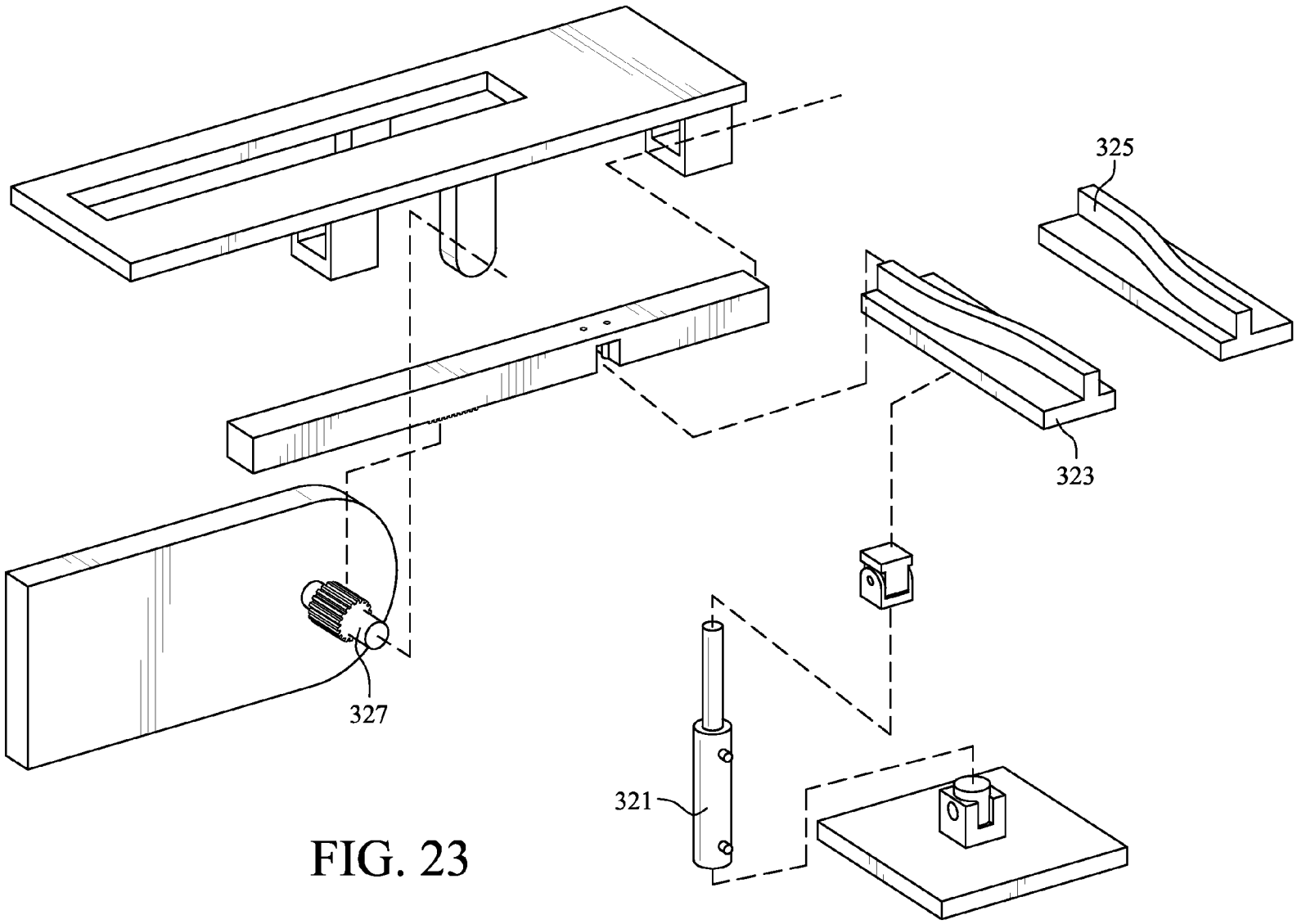
FIG. 23 is an exploded perspective view of the feed apron components shown in FIG. 22.
Figure 24A:
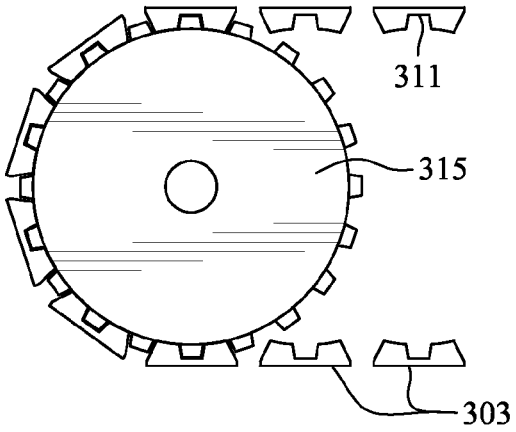
FIGS. 24*a*, 24*b* and 24*c* show various views of the slats of the feed apron shown in FIG. 21.
Figure 24B:
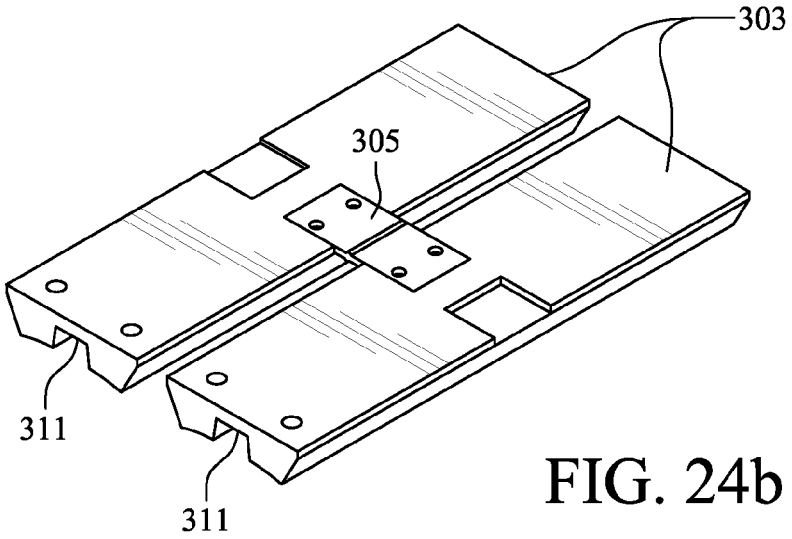
Figure 24C:
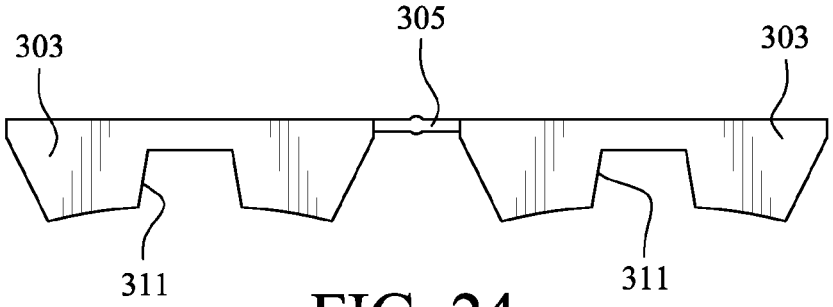

A plurality of holding or pushing rails 319 are movably mounted on the slats 303 for engaging a batt or overlapped batts on the feed apron 302 to advance the batt or batts on the feed apron 302 at a constant speed into a needle loom 304 and 304*a*. The apparatus for moving the rails 319 is illustrated in FIGS. 22 and 23 and generally comprises an air cylinder 321 or the like, guide devices 323, 325 and gearing 327.

As an alternative, the fed apron may comprise upstanding bars 312 and overlying clamp arms 314 as shown in FIG. 12 that are operated in any suitable manner.

Figure 25:
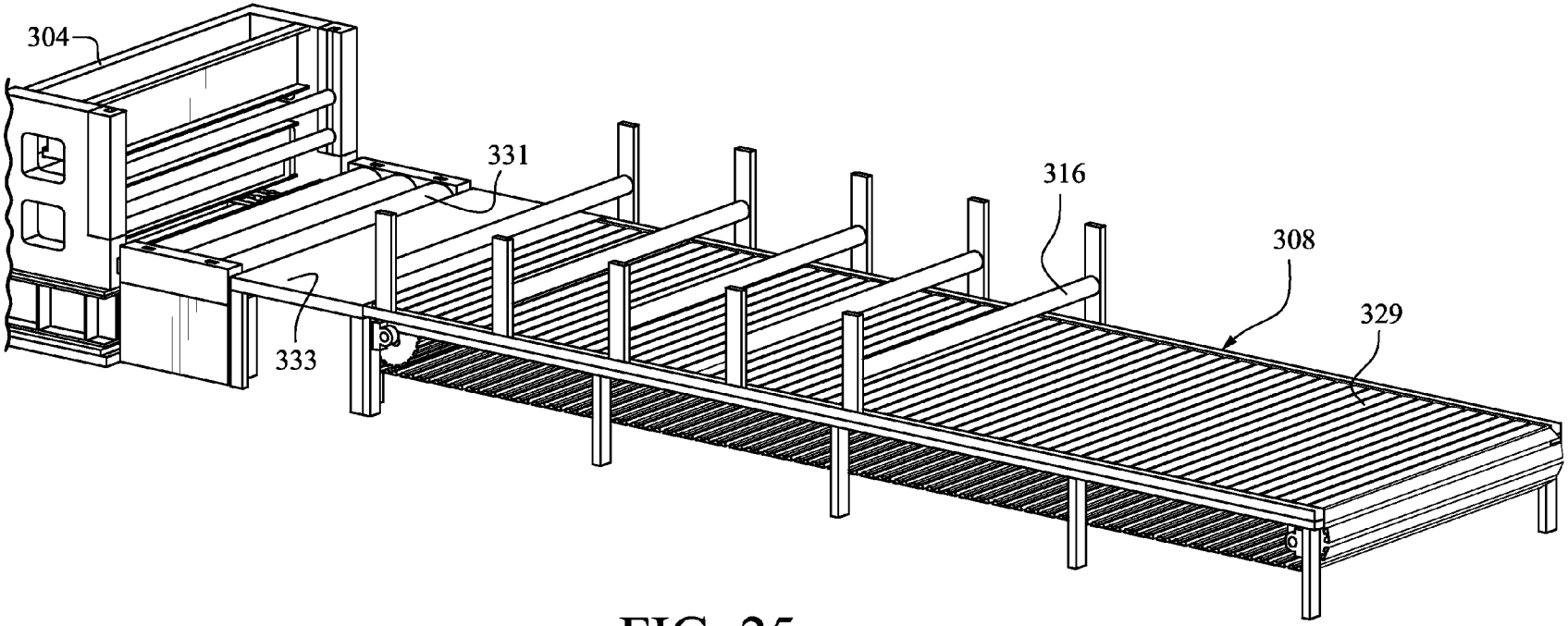
FIG. 25 shows enlarged perspective views of portions of the take up apron and associated apparatus shown in FIGS. 12 and 13.

The take up apron 308 shown in FIGS. 12 and 25 generally comprises a movable conveyor belt 329 and movable clamp arms or pinch rollers 316 for holding a batt or overlapped batts and moving them at a constant speed out of the needle loom 304, 304*a*.

Drive rollers 331 are positioned at the exit end of the needle loom 304, 304*a* and pinch rollers 306 are positioned above them to hold a batt or batts down on the drive rollers 331 and move them at a constant speed out of the needle loom 304, 304*a* and onto the take up apron 308.

A removable table 333 may be positioned between the drive rollers and the take up apron 308 when the batt or batts cannot be rolled.

From the foregoing description, it will be readily seen that the new and improved method and apparatus of the present invention can be used to produce a needled batt of any suitable material or materials and of any desired thickness and size for use in any desired field of use. Because layered needled batts of lightweight, strong and heat resistant materials of any suitable thickness can be effectively produced by the method and apparatus of the present invention, such layered batts are especially useful in aerospace and space applications, high temperature environments, marine applications or any other desired fields.

While the invention has been described in connection with what is presently considered to be the most practical and preferred embodiments, it is to be understood that the invention is not to be limited to the disclosed embodiments, but on the contrary, is intended to cover various modifications and equivalent arrangements included within the spirit and scope of the appended claims.

The invention claimed is:

1. A method of producing a needled product of a selected material or materials of a desired thickness and size, comprising:

moving a first carded batt of a selected material or materials from a feed support into a needle loom between a vertically reciprocating needle bed of the loom supporting a selected number and pattern of needles and a support bed of the loom located beneath and in spaced relation to the needle bed;

penetrating an upper surface of the first batt with the needles to tangle together fibers of the first batt and to tighten the fibers and compact the first batt, the needles extending through the first batt a distance such that they do not reach an upper surface of the support bed, the needles being able to flex laterally;

moving the needled first batt out of the needle loom;

lifting and moving the needled first batt to the feed support or a feed support for another needle loom;

positioning a second batt of a selected material or materials on the first batt in an overlapped position, moving the needle bed or support bed to increase the spacing therebetween so that the overlapped batts can pass between the needle bed and the support bed, moving the overlapped first and second batts through the needle loom so that the needles penetrate through the second batt into the first batt to connect the batts together without reaching the upper surface of the support bed, and moving the connected first and second batts out of the needle loom in the form of a multilayered needled product of a desired thickness and materials, wherein the first batt is inverted and moved through the needle loom or another needle loom in inverted position so that it is needled on an opposite side thereof before being moved to the feed support or a feed support for another needle loom to receive the second batt thereon.

2. The method of claim 1 wherein the steps are repeated a selected number of times to add additional overlapped batts and produce a multilayered needled product of a selected number of overlapped connected batts of any desired thickness and materials.

3. The method of claim 1 wherein the feed support is a movable feed apron having devices for pushing and holding down the first batt or the connected batts.

4. The method of claim 1 wherein the support bed is vertically movable by a hydraulic cylinder located in a pit beneath the needle loom.

5. The method of claim 1 wherein the support bed is slidably mounted on a frame of the needle loom and is vertically movable by a mechanical or hydraulic jack device.

6. The method of claim 1 wherein the needle bed is connected to a frame that is connected to vertically movable legs that are slidably mounted on vertical support posts and movable by hydraulic devices.

7. The method of claim 6 wherein the support posts are connected at their lower ends to vibration damping support pads.

8. The method of claim 1 wherein the needle bed and/or support bed are vertically movable to vary the spacing therebetween.

9. The method of claim 1 wherein the needle loom has a stripper plate positioned between the needle bed and the support bed, the stripper plate having openings through which the needles extend for vertical reciprocating movement.

10. The method of claim 9 wherein the stripper plate is connected to the needle bed.

11. The method of claim 1 further comprising moving the needled first batt past a magnet and metal detector after it is moved out of the needle loom.

12. The method of claim 1 wherein the needled first batt is turned over to an inverted position and deposited on the or a feed support by a crane that is movable over the feed support and the needle loom, the crane having movable gripping devices that grip the needled first batt, invert it and deposit it on the or a feed support when the crane is moved to a position over the feed support.

13. A method of producing a needled product of a selected material or materials of a desired thickness and size, comprising:

moving a first carded batt of a selected material or materials from a feed support into a needle loom between a vertically reciprocating needle bed of the loom supporting a selected number and pattern of needles and a support bed of the loom located beneath and in spaced relation to the needle bed;

penetrating an upper surface of the first batt with the needles to tangle together fibers of the first batt and to tighten the fibers and compact the first batt, the needles extending through the first batt a distance such that they do not reach an upper surface of the support bed, the needles being able to flex laterally;

moving the needled first batt out of the needle loom;

lifting and moving the needled first batt to the feed support or a feed support for another needle loom;

positioning a second batt of a selected material or materials on the first batt in an overlapped position, moving the needle bed or support bed to increase the spacing therebetween so that the overlapped batts can pass between the needle bed and the support bed, moving the overlapped first and second batts through the needle loom so that the needles penetrate through the second batt into the first batt to connect the bats together without reaching the upper surface of the support bed, and moving the connected first and second batts out of the needle loom in the form of a multilayered needled product of a desired thickness and materials;

wherein the connected first and second batts are lifted, inverted and moved to the feed support or a feed support for another needle loom, and are moved through the needle loom or another needle loom so that the needles penetrate through the first batt into the second batt without reaching the upper surface of the support bed so that the connected batts are needled on both sides thereof.

14. The method of claim 13 wherein the connected batts are moved out of the needle loom onto a take up support and are lifted from the take up support and turned over to the inverted position.

15. The method of claim 14 wherein the take up support is a movable take up apron.

16. The method of claim 13 wherein the needled and connected batts are turned over to an inverted position and deposited on the or a feed support by a crane that is movable over the feed support and the needle loom, the crane having movable gripping devices that grip the needled and connected batts, turn them over and deposit them on the or a feed support when the crane is moved to a position over the feed support.

17. The method of claim 13 wherein the needled and connected batts are moved out of the needle loom onto a take up apron and are lifted from the take up apron by a crane that is movable over the feed support, the needle loom and the take up apron, the crane having movable gripping devices that lift the connected batts from the take up apron when the crane is positioned over the take up apron, invert the connected batts and deposit the inverted connected batts on the feed support when the crane is moved over the feed support.

18. The method of claim 15 wherein the take up apron has clamping devices for engaging the connected batts thereon.

* * * * *